US011837046B2

(12) United States Patent
McPhail

(10) Patent No.: US 11,837,046 B2
(45) Date of Patent: Dec. 5, 2023

(54) SYSTEMS AND METHODS FOR WAGER AND TURNOVER TRACKING AND RELATED INCENTIVES

(71) Applicant: Aristocrat Technologies, Inc., Las Vegas, NV (US)

(72) Inventor: Gavin McPhail, Las Vegas, NV (US)

(73) Assignee: Aristocrat Technologies, Inc., Las Vegas, NV (US)

( * ) Notice: Subject to any disclaimer, the term of this patent is extended or adjusted under 35 U.S.C. 154(b) by 0 days.

(21) Appl. No.: 16/825,695

(22) Filed: Mar. 20, 2020

(65) Prior Publication Data

US 2021/0295646 A1 Sep. 23, 2021
US 2022/0172563 A9 Jun. 2, 2022

(51) Int. Cl.
*G07F 17/32* (2006.01)
*G07F 17/34* (2006.01)

(52) U.S. Cl.
CPC ..... *G07F 17/3244* (2013.01); *G07F 17/3213* (2013.01); *G07F 17/34* (2013.01)

(58) Field of Classification Search
CPC ..... G07F 17/3239; G07F 17/3244
See application file for complete search history.

(56) References Cited

U.S. PATENT DOCUMENTS 5,042,810 A * 8/1991 Williams ..... A63F 3/00157 273/143 R
5,559,312 A * 9/1996 Lucero ..... G07F 7/0866 902/23
5,560,603 A * 10/1996 Seelig ..... G07F 17/3211 463/6
5,664,998 A * 9/1997 Seelig ..... G07F 17/3211 463/6
6,059,659 A * 5/2000 Busch ..... A63F 5/00 273/274
6,210,275 B1 * 4/2001 Olsen ..... G07F 17/32 463/16
6,592,458 B1 * 7/2003 Ho ..... G07F 17/3244 273/138.2

(Continued)

FOREIGN PATENT DOCUMENTS

AU 2007319422 A1 6/2009
AU 2016265851 A1 11/2017

*Primary Examiner* — Dmitry Suhol
*Assistant Examiner* — Jason Pinheiro
(74) *Attorney, Agent, or Firm* — Armstrong Teasdale LLP

(57) ABSTRACT

A system includes a smart table configured to provide a wagering game. The smart table includes a plurality of player positions, and each player position is associated with at least one radio-frequency identification (RFID) reader of a plurality of RFID readers, each of which is configured to read data from one or more RFID chips on the smart table. The system is configured to identify a player at a player position of the plurality of player positions, and determine, using at least one RFID reader associated with the player position, a turnover accumulated by the player during a specified period, where the turnover is an aggregate amount wagered during the specified period. The system is further configured to compare the turnover accumulated by the player to a threshold turnover, and if the accumulated turnover at least meets the threshold turnover, to provide a bonus award to the player.

20 Claims, 7 Drawing Sheets

(56) References Cited

U.S. PATENT DOCUMENTS 6,702,674 B1 * 3/2004 De Bruin ..... G07F 17/32 463/16
6,966,834 B1 * 11/2005 Johnson ..... G07F 17/32 463/16
7,316,615 B2 * 1/2008 Soltys ..... G06Q 10/0639 463/25
7,329,186 B2 2/2008 Griswold et al.
7,883,407 B2 * 2/2011 Johnson ..... G07F 17/3267 463/16
8,070,593 B2 * 12/2011 DeWaal ..... G07F 17/3227 463/20
8,162,738 B2 4/2012 Erickson
8,216,061 B2 * 7/2012 Pacey ..... G07F 17/3267 463/24
8,226,474 B2 7/2012 Nguyen et al.
8,292,720 B2 * 10/2012 Davis ..... G07F 17/3279 463/17
8,319,601 B2 11/2012 Gelman et al.
8,581,721 B2 11/2013 Asher et al.
8,961,296 B2 2/2015 Walker
9,123,201 B2 * 9/2015 Guinn ..... G07F 17/32
9,640,017 B2 * 5/2017 Low ..... G07F 17/32
9,669,315 B1 * 6/2017 Curtis ..... A63F 13/798
9,694,272 B2 7/2017 Moore et al.
9,779,584 B1 * 10/2017 Czubak ..... G07F 17/34
10,486,054 B2 11/2019 Walker
10,540,843 B2 1/2020 Moore et al.
2003/0013521 A1 * 1/2003 Cole ..... G07F 17/3232 463/20
2003/0036429 A1 * 2/2003 Witty ..... G07F 17/3276 463/40
2005/0049040 A1 * 3/2005 Roberts ..... G07F 17/3258 463/25
2005/0054429 A1 * 3/2005 Baerlocher ..... G07F 17/32 463/25
2005/0119044 A1 * 6/2005 Lim ..... G07F 17/32 463/25
2006/0025210 A1 * 2/2006 Johnson ..... G07F 17/32 463/25
2006/0040717 A1 * 2/2006 Lind ..... G07F 17/3295 463/7
2006/0040725 A1 * 2/2006 Walker ..... G07F 17/32 463/16
2006/0073897 A1 * 4/2006 Englman ..... G07F 17/32 463/42
2006/0111178 A1 * 5/2006 Gallaway ..... G07F 17/3244 463/25
2006/0160625 A1 * 7/2006 Englman ..... G07F 17/3258 463/42
2006/0166731 A1 * 7/2006 Yoshimi ..... G07F 17/3267 463/20
2006/0258424 A1 * 11/2006 Green ..... G07F 17/3211 463/16
2006/0281537 A1 * 12/2006 Abbott ..... G06Q 20/20 463/25
2007/0054722 A1 * 3/2007 De Bruin ..... G07F 17/32 463/16
2007/0054733 A1 * 3/2007 Baerlocher ..... G07F 17/3258 463/27
2007/0060263 A1 * 3/2007 Englman ..... G07F 17/32 463/16
2007/0060311 A1 * 3/2007 Rowe ..... A44C 21/00 463/25
2007/0060326 A1 3/2007 Juds et al.
2007/0066398 A1 * 3/2007 Rowan ..... G07F 17/3223 463/42
2007/0117608 A1 * 5/2007 Roper ..... G07F 17/3237 463/16
2007/0173316 A1 * 7/2007 Cowan ..... G07F 17/3244 463/25
2007/0191088 A1 * 8/2007 Breckner ..... G07F 17/3258 463/20
2007/0191102 A1 * 8/2007 Coliz ..... A63F 13/30 463/42
2007/0222150 A1 * 9/2007 Wright ..... G07F 17/3223 463/19
2007/0225065 A1 * 9/2007 Wright ..... G07F 17/3267 463/25
2008/0009344 A1 * 1/2008 Graham ..... G07F 17/3239 463/16
2008/0045341 A1 * 2/2008 Englman ..... G07F 17/3211 463/25
2008/0076527 A1 * 3/2008 Low ..... G07F 17/3237 463/25
2008/0108424 A1 * 5/2008 Baerlocher ..... G07F 17/34 463/25
2008/0113772 A1 * 5/2008 Burrill ..... G07F 17/3239 463/25
2008/0176647 A1 * 7/2008 Acres ..... G07F 17/32 463/25
2008/0182655 A1 * 7/2008 DeWaal ..... G07F 17/3239 463/25
2009/0005150 A1 * 1/2009 Haveson ..... G07F 17/3276 463/20
2009/0011824 A1 * 1/2009 Englman ..... G07F 17/3276 463/16
2009/0067629 A1 3/2009 Kraszewski
2009/0069090 A1 3/2009 Moser et al.
2009/0075712 A1 * 3/2009 Englman ..... G07F 17/32 463/25
2009/0117974 A1 * 5/2009 Hornik ..... G07F 17/3276 463/20
2009/0131134 A1 * 5/2009 Baerlocher ..... G07F 17/3293 463/40
2009/0131161 A1 * 5/2009 Lim ..... G07F 17/32 463/27
2009/0170593 A1 * 7/2009 Pacey ..... G07F 17/3258 463/25
2009/0197684 A1 * 8/2009 Arezina ..... G07F 17/3216 463/42
2009/0253498 A1 * 10/2009 Wolf ..... G07F 17/32 463/29
2009/0275399 A1 11/2009 Kelly et al.
2010/0016060 A1 * 1/2010 Jaffe ..... G07F 17/3244 463/20
2010/0056248 A1 * 3/2010 Acres ..... G07F 17/34 463/20
2010/0120494 A1 * 5/2010 DeWaal ..... G07F 17/3227 463/20
2010/0178975 A1 * 7/2010 Acres ..... G07F 17/3227 463/20
2010/0216544 A1 * 8/2010 Hamlin ..... G07F 17/34 463/30
2010/0304847 A1 12/2010 Bramble
2011/0081961 A1 4/2011 Gagner et al.
2011/0086698 A1 * 4/2011 Liu ..... G07F 17/32 463/25
2011/0092278 A1 4/2011 Johnson
2011/0159949 A1 * 6/2011 Bramble ..... G07F 17/3258 463/25
2011/0223992 A1 * 9/2011 Vaughan ..... G07F 17/3248 463/42
2012/0088576 A1 * 4/2012 Shepherd ..... G07F 17/3258 463/26
2012/0135792 A1 5/2012 Johnson
2012/0231866 A1 * 9/2012 Witty ..... G07F 17/322 463/17
2012/0244928 A1 * 9/2012 Visser ..... G07F 17/3272 463/21
2012/0252565 A1 * 10/2012 Clarebrough ..... G07F 17/32 463/31
2012/0289325 A1 * 11/2012 Kyte ..... G07F 17/3258 463/27
2013/0150152 A1 * 6/2013 Naglestad Cohen ..... G07F 17/3244 463/25
2013/0252688 A1 9/2013 Johnson
2014/0179396 A1 6/2014 Aoki et al.

(56) References Cited

U.S. PATENT DOCUMENTS

| | | | | |
|---|---|---|---|---|
| 2015/0031442 | A1* | 1/2015 | Colvin | G07F 17/3244 463/25 |
| 2015/0087412 | A1* | 3/2015 | Berman | G07F 17/3267 463/29 |
| 2016/0055718 | A1* | 2/2016 | Lyons | G07F 17/3258 463/27 |
| 2018/0061183 | A1 | 3/2018 | Czubak | |
| 2018/0075690 | A1 | 3/2018 | Moore et al. | |
| 2018/0089956 | A1* | 3/2018 | Nagaragatta | G07F 17/3293 |
| 2018/0122187 | A1 | 5/2018 | Moore et al. | |
| 2019/0057571 | A1 | 2/2019 | Giuffria et al. | |
| 2019/0266852 | A1 | 8/2019 | Nagaragatta et al. | |

* cited by examiner

SYSTEMS AND METHODS FOR WAGER AND TURNOVER TRACKING AND RELATED INCENTIVES

TECHNICAL FIELD

The field of disclosure relates generally to casino gaming, and more particularly to systems and methods for wager and turnover tracking, particularly in conjunction with player incentives and rewards features.

BACKGROUND

Electronic gaming machines (EGMs), or gaming devices, provide a variety of wagering games such as, for example, and without limitation, slot games, video poker games, video blackjack games, roulette games, video bingo games, keno games, and other types of games that are frequently offered at casinos and other locations. Play on EGMs typically involves a player establishing a credit balance by inserting or otherwise submitting money and placing a monetary wager (deducted from the credit balance) on one or more outcomes of an instance, or play, of a primary game, sometimes referred to as a base game. In many games, a player may qualify for secondary games or bonus rounds by attaining a certain winning combination or other triggering event in the base game. Secondary games provide an opportunity to win additional game instances, credits, awards, jackpots, progressives, etc. Awards from any winning outcomes are typically added back to the credit balance and can be provided to the player via a printed "ticket" upon completion of a gaming session or when the player wants to "cash out."

For conventional table games, such as black jack, roulette, craps, poker, and so forth, players typically exchange personal funds for casino chips, which may then be used to place wagers at the table games. Chips may be acquired from a designated exchange point in the casino ("the cage"), or they may be acquired at the table games themselves. Traditionally, when a player wishes to acquire chips at a table game, the player lays cash on the table surface and alerts the dealer that they would like to acquire additional chips ("cash in"). The dealer takes and counts the players cash (e.g., $100), removes a number of chips from a chip stock (e.g., an inventory "float" of chips) on the table (e.g., twenty $5 chips), and gives those chips to the player in exchange for the cash. In some situations, the dealer may display the cash and the chips to a table surveillance camera (e.g., "eye in the sky"), and may make a hand signal to indicate to the camera the nature or significance of the event. The player may then use those chips at the table over the course of a gaming session at the table. When the player wishes to conclude their gaming session, they pick up their chips and vacate their position at the table.

Conventional table games are not configured to track and/or count an aggregate or total wager (sometimes referred to as "turnover") of one or more players during a gaming session or over a specified period. Further, conventional casinos are not configured to provide wager and turnover-related incentives or rewards to players during play of table and other-style games.

BRIEF DESCRIPTION

A system includes a smart table configured to provide a wagering game. The smart table includes a plurality of player positions, and each player position is associated with at least one radio-frequency identification (RFID) reader of a plurality of RFID readers, each of which is configured to read data from one or more RFID chips on the smart table. The system is configured to identify a player at a player position of the plurality of player positions, and determine, using at least one RFID reader associated with the player position, a turnover accumulated by the player during a specified period, where the turnover is an aggregate amount wagered during the specified period. The system is further configured to compare the turnover accumulated by the player to a threshold turnover, and in response to the turnover accumulated by the player being one of greater than or equal to the threshold turnover, award a bonus award to the player.

BRIEF DESCRIPTION OF THE DRAWINGS

An example embodiment of the subject matter disclosed will now be described with reference to the accompanying drawings.

DETAILED DESCRIPTION

Figure 1:
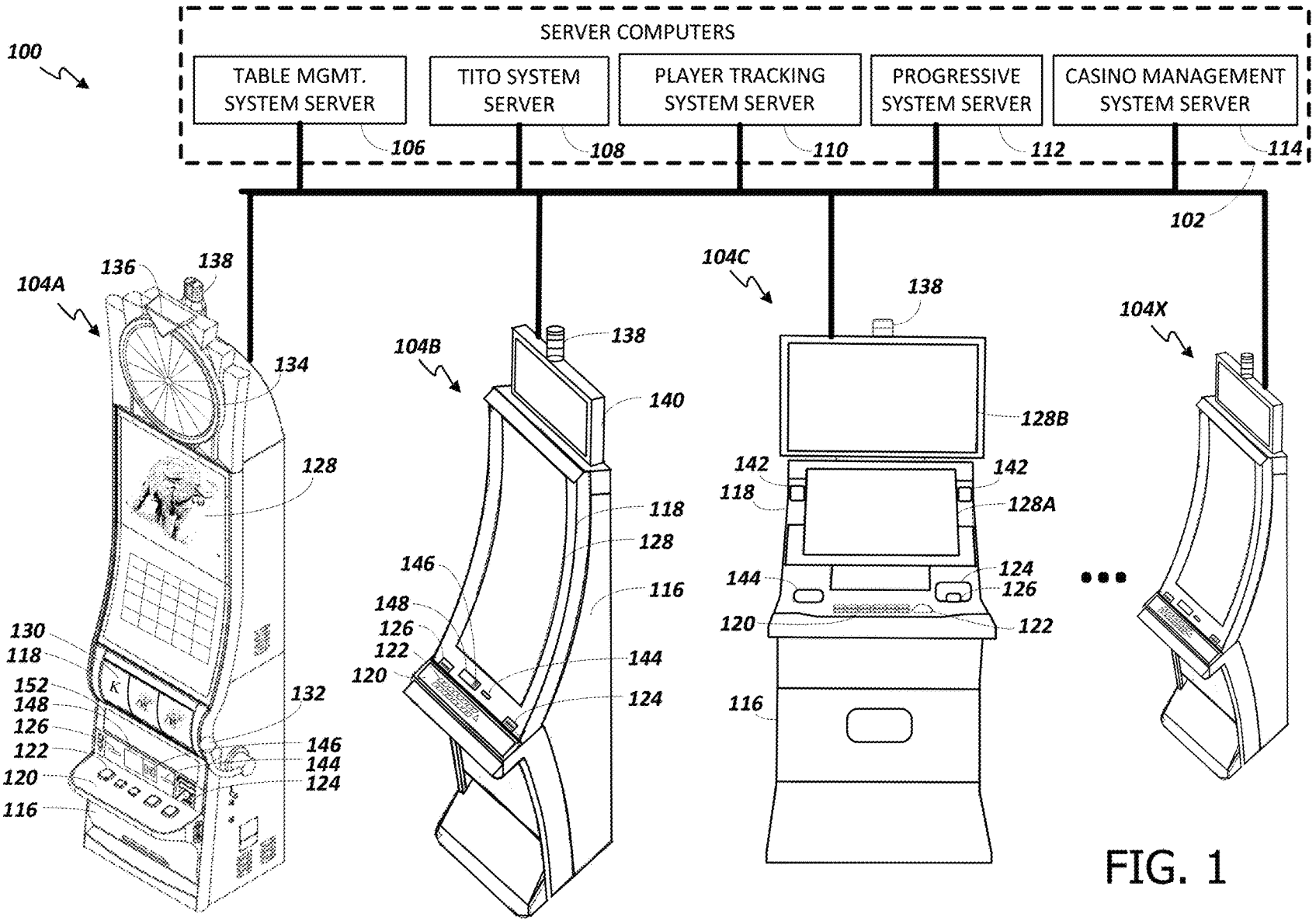
FIG. 1 is a diagram of exemplary EGMs networked with various gaming-related servers.

The present disclosure describes systems and methods for wager and turnover tracking, particularly using a smart table, and related incentives. For example, in at least some embodiments, a smart table includes a plurality of radio-frequency identifier (RFID) devices configured to read RFID data broadcast by one or more RFID chips on the smart table, as well as various other hardware devices. The smart table is therefore capable of tracking a variety of real-time game data, including, for example, player wagers during specific hands (e.g., where the wagering game is a card game), total amounts wagered by players over time (also referred to herein as "turnover"), player positioning, timing of play rounds, play results, and such.

As a result, during play of any of a variety of wagering games on the smart table, total turnover accumulated by players at the smart table may be tracked, and a variety of incentives offered in association. For example, a turnover incentive may specify that a player will receive a bonus award if the player accumulates a threshold turnover (i.e., if the player reaches a turnover goal) within a specified time period. In some embodiments, turnover goals may be extensively customized. For instance, in at least one embodiment, players may be grouped in several levels or tiers (e.g., player loyalty level), and turnover goals may be applied to different player tiers based upon preferences or qualifications of players in respective tiers (e.g., greater awards for higher loyalty levels). In another example, players may specify or select turnover incentives in which they wish to participate, such as from a list of upcoming or otherwise available turnover incentives.

The term "ticket," as used herein, refers to a printed slip of paper that may be generated in a casino environment for the various aspects and embodiments described herein. The term "voucher," as used herein, refers to a type of ticket that embodies direct cash value. For example, when a player cashes out of an EGM, the EGM prints a ticket embodying that player's balance within the EGM that the player may then use at another EGM, or redeem at the cage of the casino for cash, or exchange at a table game for casino chips as described herein. As such, this example ticket is a voucher. The terms "bonus ticket" or "reward ticket," as used herein, refers to a type of ticket that embodies a bonus or reward given to the player, usually by the casino, for various value other than direct cash value (e.g., non-cashable). For example, bonus tickets or reward tickets may include non-cashable "free play vouchers" that may be redeemed for free plays (e.g., at table games), isolating the voucher to be used for a tokenized game hand. Various example bonus tickets or reward tickets are described herein. The term "ticket" may be used interchangeably herein with either the term "voucher" or the terms "bonus ticket" or "reward ticket" based on the context within which the term is used.

The terms "amount" and "value," as used herein and when referring to casino chips and tickets, is generally used to refer to a dollar value of such chips or tickets. The term "number" or "count," as used herein and when referring to casino chips, refers to a numerical count of individual chips. In other words, and for example, a player may have five $20 chips, where five is the number of chips or the chip count, and where $100 is the amount of chips or the value of chips.

Further, as used herein and as described in additional detail below, the terms "turnover" and "accumulated turnover" refer to a total or aggregate amount wagered by a player during a time period, where the time period may be variously set by, for example, a casino operator. For example, if a time period of two hours is established, a player may accumulate turnover in the aggregate amount wagered by the player during the two-hour period.

FIG. 1 illustrates several different models of EGMs which may be networked to various gaming related servers. Shown is a system 100 in a gaming environment including one or more server computers 102 (e.g., slot servers of a casino) that are in communication, via a communications network, with one or more gaming devices 104A-104X (EGMs, slots, video poker, bingo machines, etc.) that can implement one or more aspects of the present disclosure. The gaming devices 104A-104X may alternatively be portable and/or remote gaming devices such as, but not limited to, a smart phone, a tablet, a laptop, or a game console, although such devices may require specialized software and/or hardware to comply with regulatory requirements regarding devices used for wagering or games of chance in which monetary awards are provided.

Communication between the gaming devices 104A-104X and the server computers 102, and among the gaming devices 104A-104X, may be direct or indirect, such as over the Internet through a website maintained by a computer on a remote server or over an online data network including commercial online service providers, Internet service providers, private networks, and the like. In other embodiments, the gaming devices 104A-104X may communicate with one another and/or the server computers 102 over RF, cable TV, satellite links and the like.

In some embodiments, server computers 102 may not be necessary and/or preferred. For example, in one or more embodiments, a stand-alone gaming device such as gaming device 104A, gaming device 104B or any of the other gaming devices 104C-104X can implement one or more aspects of the present disclosure. However, it is typical to find multiple EGMs connected to networks implemented with one or more of the different server computers 102 described herein.

The server computers 102 may include a central determination gaming system server (not separately shown), a table management system server 106, a ticket-in-ticket-out (TITO) system server 108, a player tracking system server 110, a progressive system server 112, and/or a casino management system server 114. Gaming devices 104A-104X may include features to enable operation of any or all servers for use by the player and/or operator (e.g., the casino, resort, gaming establishment, tavern, pub, etc.). For example, game outcomes may be generated on a central determination gaming system server and then transmitted over the network to any of a group of remote terminals or remote gaming devices 104A-104X that utilize the game outcomes and display the results to the players.

Gaming device 104A is often of a cabinet construction which may be aligned in rows or banks of similar devices for placement and operation on a casino floor. The gaming device 104A often includes a main door 154 which provides access to the interior of the cabinet. Gaming device 104A typically includes a button area or button deck 120 accessible by a player that is configured with input switches or buttons 122, an access channel for a bill validator 124, and/or an access channel for a ticket-out printer 126.

In FIG. 1, gaming device 104A is shown as a Relm XL™ model gaming device manufactured by Aristocrat® Technologies, Inc. As shown, gaming device 104A is a reel machine having a gaming display area 118 comprising a number (typically 3 or 5) of mechanical reels 130 with various symbols displayed on them. The reels 130 are independently spun and stopped to show a set of symbols within the gaming display area 118 which may be used to determine an outcome to the game.

In many configurations, the gaming machine 104A may have a main display 128 (e.g., video display monitor) mounted to, or above, the gaming display area 118. The main display 128 can be a high-resolution LCD, plasma, LED, or OLED panel which may be flat or curved as shown, a cathode ray tube, or other conventional electronically controlled video monitor.

In some embodiments, the bill validator 124 may also function as a "ticket-in" reader that allows the player to use a casino issued credit ticket (e.g., a voucher) to load credits onto the gaming device 104A (e.g., in a cashless ticket ("TITO") system). In such cashless embodiments, the gaming device 104A may also include a "ticket-out" printer 126 for outputting a credit ticket when a "cash out" button is pressed. Cashless TITO systems are used to generate and track unique bar-codes or other indicators printed on tickets to allow players to avoid the use of bills and coins by loading credits using a ticket reader and cashing out credits using a ticket-out printer 126 on the gaming device 104A. The gaming machine 104A can have hardware meters for purposes including ensuring regulatory compliance and monitoring the player credit balance. In addition, there can be additional meters that record the total amount of money wagered on the gaming machine, total amount of money deposited, total amount of money withdrawn, total amount of winnings on gaming device 104A. In some embodiments, the cashless ticket system may integrate with the table ticketing system to facilitate allowing players to exchange tickets for chips or chips for tickets at table games.

In some embodiments, a player tracking card reader 144, a transceiver for wireless communication with a player's smartphone, a keypad 146, and/or an illuminated display 148 for reading, receiving, entering, and/or displaying player tracking information is provided in EGM 104A. In such embodiments, a game controller within the gaming device 104A can communicate with the player tracking system server 110 to send and receive player tracking information.

Gaming device 104A may also include a bonus topper wheel 134. When bonus play is triggered (e.g., by a player achieving a particular outcome or set of outcomes in the primary game), bonus topper wheel 134 is operative to spin and stop with indicator arrow 136 indicating the outcome of the bonus game. Bonus topper wheel 134 is typically used to play a bonus game, but it could also be incorporated into play of the base or primary game.

A candle 138 may be mounted on the top of gaming device 104A and may be activated by a player (e.g., using a switch or one of buttons 122) to indicate to operations staff that gaming device 104A has experienced a malfunction or the player requires service. The candle 138 is also often used to indicate a jackpot has been won and to alert staff that a hand payout of an award may be needed.

There may also be one or more information panels 152 which may be a back-lit, silkscreened glass panel with lettering to indicate general game information including, for example, a game denomination (e.g., $0.25 or $1), pay lines, pay tables, and/or various game related graphics. In some embodiments, the information panel(s) 152 may be implemented as an additional video display.

Gaming devices 104A have traditionally also included a handle 132 typically mounted to the side of main cabinet 116 which may be used to initiate game play.

Many or all the above described components can be controlled by circuitry (e.g., a gaming controller) housed inside the main cabinet 116 of the gaming device 104A, the details of which are shown in FIG. 2.

Note that not all gaming devices suitable for implementing embodiments of the present disclosure necessarily include top wheels, top boxes, information panels, cashless ticket systems, and/or player tracking systems. Further, some suitable gaming devices have only a single game display that includes only a mechanical set of reels and/or a video display, while others are designed for bar counters or table tops and have displays that face upwards.

An alternative example gaming device 104B illustrated in FIG. 1 is the Arc™ model gaming device manufactured by Aristocrat® Technologies, Inc. Note that where possible, reference numerals identifying similar features of the gaming device 104A embodiment are also identified in the gaming device 104B embodiment using the same reference numbers. Gaming device 104B does not include physical reels and instead shows game play functions on main display 128. An optional topper screen 140 may be used as a secondary game display for bonus play, to show game features or attraction activities while a game is not in play, or any other information or media desired by the game designer or operator. In some embodiments, topper screen 140 may also or alternatively be used to display progressive jackpot prizes available to a player during play of gaming device 104B.

Example gaming device 104B includes a main cabinet 116 including a main door 154 which opens to provide access to the interior of the gaming device 104B. The main or service door 154 is typically used by service personnel to refill the ticket-out printer 126 and collect bills and tickets inserted into the bill validator 124. The main or service door 154 may also be accessed to reset the machine, verify and/or upgrade the software, and for general maintenance operations.

Another example gaming device 104C shown is the Helix™ model gaming device manufactured by Aristocrat® Technologies, Inc. Gaming device 104C includes a main display 128A that is in a landscape orientation. Although not illustrated by the front view provided, the landscape display 128A may have a curvature radius from top to bottom, or alternatively from side to side. In some embodiments, display 128A is a flat panel display. Main display 128A is typically used for primary game play while secondary display 128B is typically used for bonus game play, to show game features or attraction activities while the game is not in play or any other information or media desired by the game designer or operator. In some embodiments, example gaming device 104C may also include speakers 142 to output various audio such as game sound, background music, etc.

Many different types of games, including mechanical slot games, video slot games, video poker, video black jack, video pachinko, keno, bingo, and lottery, may be provided with or implemented within the depicted gaming devices 104A-104C and other similar gaming devices. Each gaming device may also be operable to provide many different games. Games may be differentiated according to themes, sounds, graphics, type of game (e.g., slot game vs. card game vs. game with aspects of skill), denomination, number of paylines, maximum jackpot, progressive or non-progressive, bonus games, and may be deployed for operation in Class 2 or Class 3, etc.

Figure 2A:
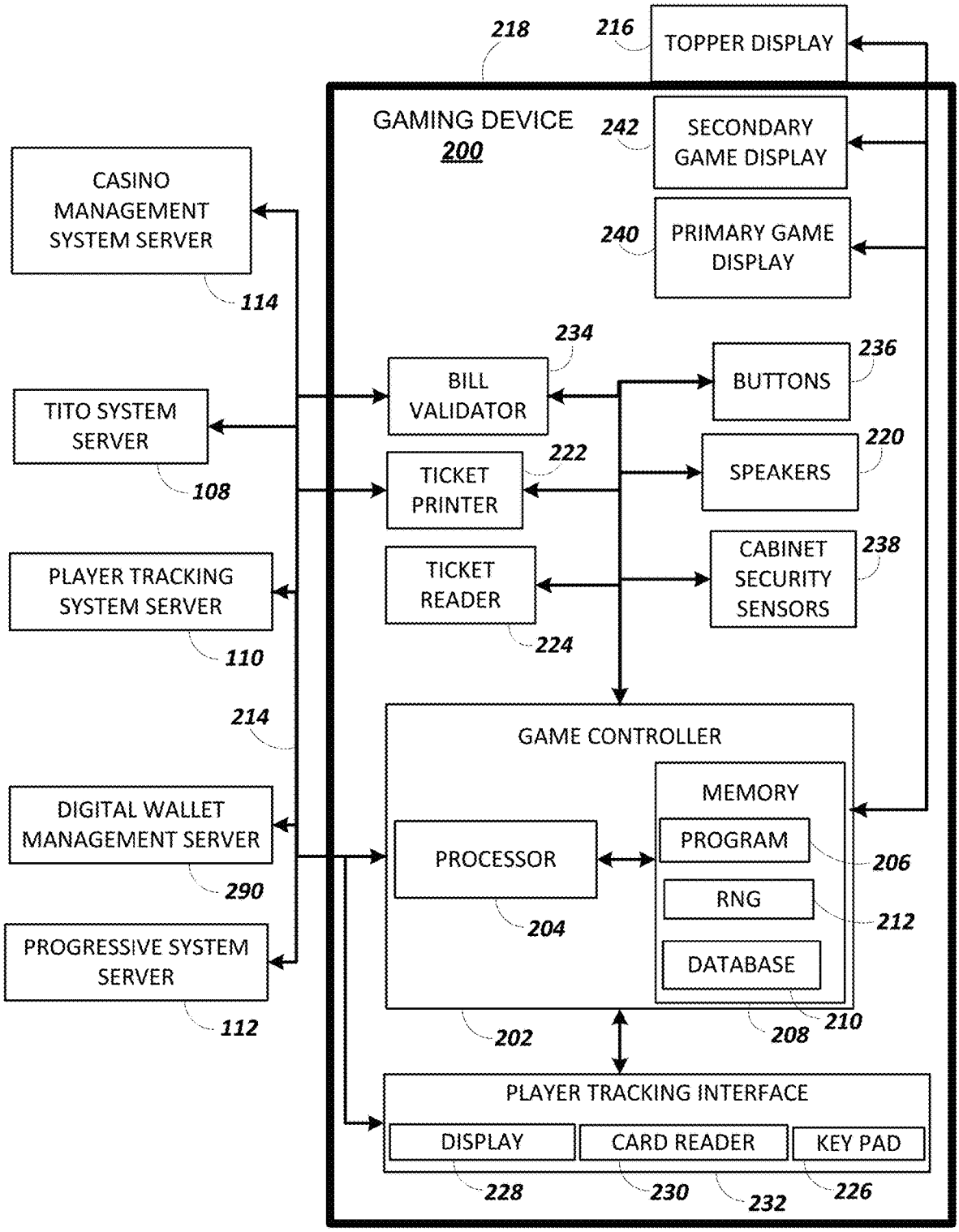
FIG. 2A is a block diagram depicting exemplary internal electronic components of a gaming device connected to various external systems.

FIG. 2A is a block diagram depicting exemplary internal electronic components of a gaming device 200 connected to various external systems. All or parts of the example gaming device 200 shown could be used to implement any one of the example gaming devices 104A-X depicted in FIG. 1. The games available for play on the gaming device 200 are controlled by a game controller 202 that includes one or more processors 204 and a game that may be stored as game software or a program 206 in a memory 208 coupled to the processor 204. The memory 208 may include one or more mass storage devices or media that are housed within gaming device 200. Within the mass storage devices and/or memory 208, one or more databases 210 may be provided for use by the program 206. A random number generator (RNG) 212 that can be implemented in hardware and/or software is typically used to generate random numbers that are used in the operation of game play to ensure that game play outcomes are random and meet regulations for a game of chance.

Alternatively, a game instance (i.e. a play or round of the game) may be generated on a remote gaming device such as the central determination gaming system server. The game instance is communicated to gaming device 200 via the network 214 and then displayed on gaming device 200. Gaming device 200 may execute game software, such as but not limited to video streaming software that allows the game to be displayed on gaming device 200. When a game is stored on gaming device 200, it may be loaded from a memory 208 (e.g., from a read only memory (ROM)) or from the central determination gaming system server to memory 208. The memory 208 may include RAM, ROM or another form of storage media that stores instructions for execution by the processor 204.

The gaming device 200 may include a topper display 216 or another form of a top box (e.g., a topper wheel, a topper screen, etc.) which sits above cabinet 218. The cabinet 218 or topper display 216 may also house a number of other components which may be used to add features to a game being played on gaming device 200, including speakers 220, a ticket printer 222 which prints bar-coded tickets or other media or mechanisms for storing or indicating a player's credit value, a ticket reader (or ticket scanner) 224 which reads bar-coded tickets or other media or mechanisms for storing or indicating a player's credit value, and a player tracking interface 232. The player tracking interface 232 may include a keypad 226 for entering information, a player tracking display 228 for displaying information (e.g., an illuminated or video display), a card reader 230 for receiving data and/or communicating information to and from media or a device such as a smart phone enabling player tracking. Ticket printer 222 may be used to print tickets for a TITO system server 108. The gaming device 200 may further include a bill validator 234, player-input buttons 236 for player input, cabinet security sensors 238 to detect unauthorized opening of the cabinet 218, a primary game display 240, and a secondary game display 242, each coupled to and operable under the control of game controller 202.

Gaming device 200 may be connected over network 214 to player tracking system server 110. Player tracking system server 110 may be, for example, an OASIS® system manufactured by Aristocrat® Technologies, Inc. Player tracking system server 110 is used to track play (e.g. amount wagered, games played, time of play and/or other quantitative or qualitative measures) for individual players so that an operator may reward players in a loyalty program. The player may use the player tracking interface 232 to access his/her account information, activate free play, and/or request various information. Player tracking or loyalty programs seek to reward players for their play and help build brand loyalty to the gaming establishment. The rewards typically correspond to the player's level of patronage (e.g., to the player's playing frequency and/or total amount of game plays at a given casino). Player tracking rewards may be complimentary and/or discounted meals, lodging, entertainment and/or additional play. Player tracking information may be combined with other information that is now readily obtainable by a casino management system.

Gaming devices, such as gaming devices 104A-104X, 200, are highly regulated to ensure fairness and, in many cases, gaming devices 104A-104X, 200 are operable to award monetary awards (e.g., typically dispensed in the form of a redeemable voucher). Therefore, to satisfy security and regulatory requirements in a gaming environment, hardware and software architectures are implemented in gaming devices 104A-104X, 200 that differ significantly from those of general-purpose computers. Adapting general purpose computers to function as gaming devices 200 is not simple or straightforward because of: 1) the regulatory requirements for gaming devices 200, 2) the harsh environment in which gaming devices 200 operate, 3) security requirements, 4) fault tolerance requirements, and 5) the requirement for additional special purpose componentry enabling functionality of an EGM. These differences require substantial engineering effort with respect to game design implementation, hardware components and software.

When a player wishes to play the gaming device 200, he/she can insert cash or a ticket voucher through a coin acceptor (not shown) or bill validator 234 to establish a credit balance on the gaming machine. The credit balance is used by the player to place wagers on instances of the game and to receive credit awards based on the outcome of winning instances. The credit balance is decreased by the amount of each wager and increased upon a win. The player can add additional credits to the balance at any time. The player may also optionally insert a loyalty club card into the card reader 230. During the game, the player views the game outcome on one or more of the primary game display 240 and secondary game display 242. Other game and prize information may also be displayed.

For each game instance, a player may make selections, which may affect play of the game. For example, the player may vary the total amount wagered by selecting the amount bet per line and the number of lines played. In many games, the player is asked to initiate or select options during course of game play (such as spinning a wheel to begin a bonus round or select various items during a feature game). The player may make these selections using the player-input buttons 236, the primary game display 240 which may be a touch screen, or using some other device which enables a player to input information into the gaming device 200.

During certain game events, the gaming device 200 may display visual and auditory effects that can be perceived by the player. These effects add to the excitement of a game, which makes a player more likely to enjoy the playing experience. Auditory effects include various sounds that are projected by the speakers 220. Visual effects include flashing lights, strobing lights or other patterns displayed from lights on the gaming device 200 or from lights behind the information panel 152 (FIG. 1).

When the player is done, he/she cashes out the credit balance (typically by pressing a "cash out" button to receive a ticket from the ticket printer 222). The ticket may be redeemed for cash money or inserted into another machine to establish a credit balance for further play. In some embodiments, tickets may be redeemed for chips at table games as described below.

While an example gaming device 200 has been described in regard to FIG. 2A, certain aspects of the present disclosure may be implemented by gaming devices that lack one or more of the above-described components. For example, not all gaming devices suitable for implementing aspects of the present disclosure necessarily include top boxes, information panels, cashless ticket systems, and/or player tracking systems. Further, some suitable gaming devices may include a single game display having mechanical reels or a video display. Moreover, other embodiments may be designed for bar tables and have displays that face upwards.

Many different types of wagering games, including mechanical slot games, video slot games, video poker, video blackjack, video pachinko, keno, bingo, and lottery, may be provided by the gaming device 200. In particular, the gaming device 200 may be operable to provide many different instances of games of chance. The instances may be differentiated according to themes, sounds, graphics, type of game (e.g., slot game vs. card game vs. game with aspects of skill), denomination, number of paylines, maximum jackpot, progressive or non-progressive, bonus games, class 2 or class 3, etc.

The gaming device 200 may allow a player to select a game of chance, skill, or combination thereof, to play from a plurality of instances available on the gaming device 200. For example, the gaming device 200 may provide a menu with a list of the instances of games that are available for play on the gaming device 200 and a player may be able to select, from the list, a game that they wish to play.

Figure 2B:
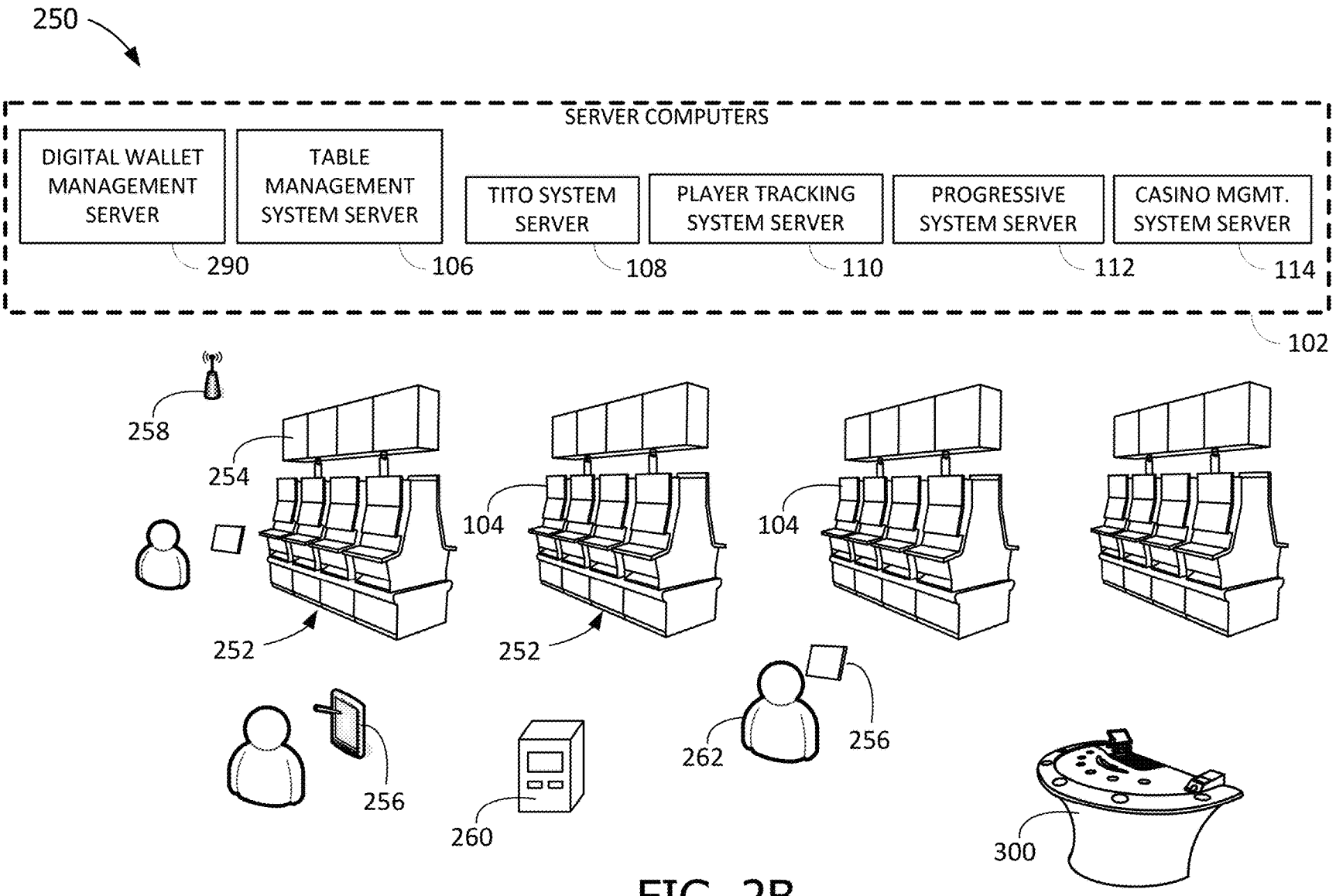
FIG. 2B illustrates an example gaming environment in which the gaming device shown in FIGS. 1 and 2A may appear.

FIG. 2B illustrates an example gaming environment 250 in which the gaming devices 104, 200 shown in FIGS. 1 and 2A may appear. In the example embodiment, the gaming environment 250 is a physical venue of a casino that includes banks 252 of gaming devices 104. In this example, each bank 252 of gaming devices 104 includes a corresponding gaming signage system 254. In this example, the gaming environment 250 includes a smart table 300 that is configured for table gaming. Details of the smart table 300 are described below with reference to FIG. 3. The gaming environment 250 also includes mobile gaming devices 256 which, in various embodiments, may present wagering games or social games. The mobile gaming devices 256 may, for example, include tablet devices, cellular phones, smart phones, or other handheld computing devices. In this example, the mobile gaming devices 256 are configured for communication with one or more other devices in the gaming environment 250, including but not limited to one or more of the gaming devices 104, one or more smart tables 300, one or more kiosk(s) 260, and one or more of the server computers 102, via wireless access points 258. In some implementations, the mobile gaming devices 256 may be configured for communication with one or more other devices in the gaming environment 250, including but not limited to one or more of the gaming devices 104, one or more smart tables 300, one or more kiosk(s) 260, via wireless communications (e.g., near-field communication (NFC), Bluetooth, Wi-Fi, or such, via one of the "beacons" described herein).

According to some examples, the mobile gaming devices 256 may be configured for stand-alone determination of game outcomes. However, in some alternative implementations the mobile gaming devices 256 may be configured to receive game outcomes from another device, such as the central determination gaming system server 106, one of the gaming devices 104, etc.

Some mobile gaming devices 256 may be configured to accept monetary credits from a credit or debit card, via a wireless interface (e.g., via a wireless payment app), via tickets, via a patron casino account, etc. However, some mobile gaming devices 256 may not be configured to accept monetary credits via a credit or debit card. Some mobile gaming devices 256 may include a ticket reader and/or a ticket printer whereas some mobile gaming devices 256 may not, depending on the particular implementation.

In some embodiments, the gaming environment 250 may include one or more kiosks 260 that are configured to facilitate monetary transactions involving the mobile gaming devices 256, which may include cash out and/or cash in transactions. The kiosk(s) 260 may be configured for wired and/or wireless communication with the mobile gaming devices 256. The kiosk(s) 260 may be configured to accept monetary credits from casino patrons 262 or to dispense monetary credits to casino patrons 262 via cash, a credit or debit card, via a wireless interface (e.g., via a wireless payment app), via tickets, digital wallet, or such. According to some examples, the kiosk(s) 260 may be configured to accept monetary credits from a casino patron and to provide a corresponding amount of monetary credits to a mobile gaming device 256 for wagering purposes (e.g., via a wireless link such as an NFC link). In some such examples, when a casino patron 262 is ready to cash out, the casino patron 262 may select a cash out option provided by the mobile gaming device 256, which may include a real button or a virtual button (e.g., a button provided via a graphical user interface) in some instances. In some such examples, the mobile gaming device 256 may send a "cash out" signal to the kiosk 260 via a wireless link in response to receiving a "cash out" indication from a casino patron. The kiosk 260 may provide monetary credits to the patron 262 corresponding to the "cash out" signal, which may be in the form of cash, a credit ticket, a credit transmitted to a financial account corresponding to the casino patron, a digital wallet account, or such.

In some implementations, a cash-in process and/or a cash-out process may be facilitated by the TITO system server 108. For example, the TITO system server 108 may control, or at least authorize, ticket-in and ticket-out transactions that involve a mobile gaming device 256 and/or a kiosk 260.

Some mobile gaming devices 256 may be configured for receiving and/or transmitting player loyalty information. For example, some mobile gaming devices 256 may be configured for wireless communication with the player tracking system server 110. Some mobile gaming devices 256 may be configured for receiving and/or transmitting player loyalty information via wireless communication with a patron's player loyalty card, a patron's smartphone, etc.

According to some implementations, a mobile gaming device 256 may be configured to provide safeguards that prevent the mobile gaming device 256 from being used by an unauthorized person. For example, some mobile gaming devices 256 may include one or more biometric sensors and may be configured to receive input via the biometric sensor(s) to verify the identity of an authorized patron. Some mobile gaming devices 256 may be configured to function only within a predetermined or configurable area, such as within a casino gaming area (e.g., based on GPS and geofencing).

Figure 2C:
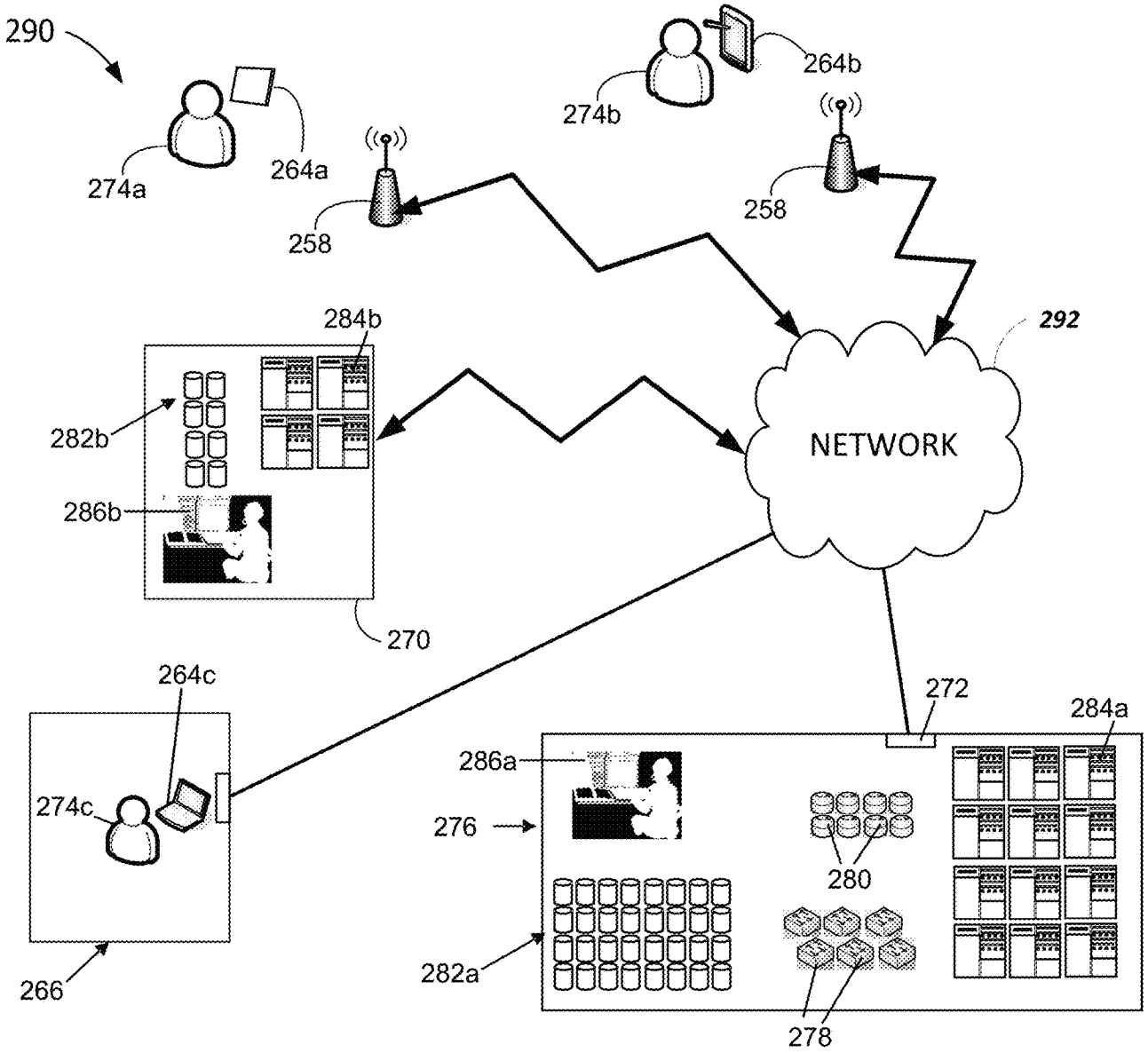
FIG. 2C is a diagram that shows examples of components of a system for providing online gaming according to some aspects of the present disclosure.

FIG. 2C is a diagram that shows examples of components of a system 290 for providing online gaming according to some aspects of the present disclosure. As with other figures presented in this disclosure, the numbers, types and arrangements of gaming devices shown in FIG. 2C are merely shown by way of example. In the example embodiment, various gaming devices, including but not limited to end user devices (EUDs) 264*a*, 264*b* and 264*c* are capable of communication via one or more networks 292. The networks 292 may, for example, include one or more cellular telephone networks, the Internet, Wi-Fi networks, satellite networks, or such. In this example, the EUDs 264*a* and 264*b* are mobile devices. For example, the EUD 264*a* may be a tablet device and the EUD 264*b* may be a smart phone. The EUD 264*c* is a laptop computer that is located within a residence 266 at the time depicted in FIG. 2C. Accordingly, in this example the hardware of EUDs 264 is not specifically configured for online gaming, although each EUD 264 is configured with software for online gaming. For example, each EUD 264 may be configured with a web browser, installed gaming applications, player apps, or such. Other implementations may include other types of EUD 264, some of which may be specifically configured for online gaming.

In this example, a gaming data center 276 includes various devices that are configured to provide online wagering games or social games via the networks 292. The gaming data center 276 is capable of communication with the networks 292 via the gateway 272. In this example, switches 278 and routers 280 are configured to provide network connectivity for devices of the gaming data center 276, including storage devices 282*a*, servers 284*a* and one or more workstations 286*a*. The servers 284*a* may, for example, be configured to provide access to a library of games for online game play or for download and installation by remote devices (e.g., EUDs 264). In some examples, code for executing at least some of the games may initially be stored on one or more of the storage devices 282*a*. The code may be subsequently loaded onto a server 284*a* after selection by a player via an EUD 264 and communication of that selection from the EUD 264 via the networks 292. The server 284*a* onto which code for the selected game has been loaded may provide the game according to selections made by a player and indicated via the player's EUD 264. In other examples, code for executing at least some of the games may initially be stored on one or more of the servers 284*a*. Although only one gaming data center 276 is shown in FIG. 2C, some implementations may include multiple gaming data centers 276.

In this example, a financial institution data center 270 is also configured for communication via the networks 292. Here, the financial institution data center 270 includes servers 284*b*, storage devices 282*b*, and one or more workstations 286*b*. According to this example, the financial institution data center 270 is configured to maintain financial accounts, such as checking accounts, savings accounts, loan accounts, payment card accounts, rewards accounts, loyalty accounts, player accounts, digital wallet accounts, or such. In some implementations one or more of the authorized users 274*a*-274*c* may maintain at least one financial account with the financial institution that is serviced via the financial institution data center 270.

According to some implementations, the gaming data center 276 may be configured to provide online wagering games in which money may be won or lost, or various social games, some of which may use virtual currencies. According to some such implementations, one or more of the servers 284*a* may be configured to monitor player credit balances, which may be expressed in game credits, in real or virtual currency units, or in any other appropriate manner. In some implementations, the server(s) 284*a* may be configured to obtain financial credits from and/or provide financial credits to one or more financial institutions, according to a player's "cash in" selections, wagering game results and a player's "cash out" instructions. According to some such implementations, the server(s) 284*a* may be configured to electronically credit or debit the account of a player that is maintained by a financial institution, e.g., an account that is maintained via the financial institution data center 270. The server(s) 284*a* may, in some examples, be configured to maintain an audit record of such transactions.

In some embodiments, the gaming data center 276 may be configured to provide online wagering games for which credits may not be exchanged for cash or the equivalent. In some such examples, players may purchase game credits for online game play, but may not "cash out" for monetary credit after a gaming session. Moreover, although the financial institution data center 270 and the gaming data center 276 include their own servers and storage devices in this example, in some examples the financial institution data center 270 and/or the gaming data center 276 may use offsite "cloud-based" servers and/or storage devices. In some alternative examples, the financial institution data center 270 and/or the gaming data center 276 may rely entirely on cloud-based servers.

One or more types of devices in the gaming data center 276 (or elsewhere) may be capable of executing middleware, e.g., for data management and/or device communication. Authentication information, player tracking information, etc., including but not limited to information obtained by EUDs 264 and/or other information regarding authorized users of EUDs 264 (including but not limited to the authorized users 274*a*-274*c*), may be stored on storage devices 282 and/or servers 284. Other game-related information and/or software, such as information and/or software relating to leaderboards, players currently playing a game, game themes, game-related promotions, game competitions, etc., also may be stored on storage devices 282 and/or servers 284. In some implementations, some such game-related software may be available as "apps" and may be downloadable (e.g., from the gaming data center 276) by authorized users.

In some examples, authorized users and/or entities (such as representatives of gaming regulatory authorities) may obtain gaming-related information via the gaming data center 276. One or more other devices (such EUDs 264 or devices of the gaming data center 276) may act as intermediaries for such data feeds. Such devices may, for example, be capable of applying data filtering algorithms, executing data summary and/or analysis software, etc. In some implementations, data filtering, summary and/or analysis software may be available as "apps" and downloadable by authorized users.

In some embodiments, the financial institution data center 270 may be configured for communication with one or more devices in the gaming environment 250. As noted above, the mobile gaming devices 256 may or may not be specialized gaming devices, depending on the particular implementation. In some examples, the mobile gaming devices 256 may be end user devices (EUDs 264), such as tablet devices, cellular phones, smart phones and/or other handheld devices. For example, referring again to FIG. 2B, a digital wallet management server 290 may include some of the server computers 102. (As used herein, the terms "mobile wallet" and "digital wallet" will be used synonymously.) The digital wallet management server 290 may be configured for communication with one or more financial institution data centers, such as data centers configured for implementing bank accounts (e.g., checking accounts), credit card accounts, debit card accounts, digital wallets, and such.

The digital wallet management server 290 may be configured to provide functionality related to digital wallets, including but not limited to the establishment of digital wallet accounts and implementing financial transactions made via digital wallets. The digital wallet management server 290 may communicate with, for example, the mobile gaming devices 256 (such as smartphones of users associated with digital wallets), with the gaming devices 104, with the smart table 300, with kiosks 260, or with other devices or entities, such as devices associated with merchants or service providers, for the purposes of completing various financial transactions involving digital wallets. These financial transactions may include, but are not limited to, financial transactions relating to wager gaming, such as providing credits for wager gaming on an EGM, providing credits for table gaming, facilitating cash out transactions relating to wager gaming on gaming devices 104 or at smart tables 300, establishing lines of credit or markers, or paying back debts such as markers. In some embodiments, a digital wallet may be used for purposes other than wager gaming (e.g., at a casino restaurant, a casino bar, a casino entertainment venue and/or a casino retail store, for reward collection and redemption). In some implementations a digital wallet may be used for transactions outside the casino context. For example, the digital wallet may be used during online gaming (e.g., to purchase apps, virtual currency, or other in-game purchases), for making in-store or online purchases (e.g., purchases of goods or services related to a casino but available online), or such. One or more devices of the digital wallet management server 290 may be configured to provide security (e.g., encryption, authentication, authorization) for communications involving transactions made via a digital wallet.

In some embodiments, the gaming environment 250 may include one or more kiosks 260. According to some implementations, the kiosk(s) 260 may be part of the digital wallet management server 290 even though in FIG. 2B the kiosk(s) 260 and the digital wallet management server 290 are shown separately. The kiosk(s) 260 may be configured for communication with other devices of the digital wallet management server 290 (e.g., with one or more servers of the digital wallet management server 290), for example, to allow digital wallet-based transactions at the kiosk 260 (e.g., purchasing credits from a digital wallet account to cash or to a TITO ticket, redeeming a TITO ticket to a digital wallet account, redeeming a reward stored in a digital wallet).

In some embodiments, the kiosk(s) 260 may be configured to facilitate monetary transactions involving a digital wallet (e.g., monetary transactions involving digital wallet software being executed by one or more of the mobile gaming devices 256). Such transactions may include, but are not limited to, cash out and/or cash in transactions. The kiosk(s) 260 may be configured for wired and/or wireless communication with the mobile gaming devices 256. The kiosk(s) 260 may be configured to accept monetary credits from casino patrons 262 and/or to dispense monetary credits to casino patrons 262 via cash, a credit or debit card, via a wireless interface (e.g., via a wireless payment app), via tickets, etc. Accordingly, in some such examples, the kiosk(s) 260 may be configured for communication with one or more financial institution data centers.

In some embodiments, the kiosk(s) 260 may be configured to accept monetary credits from a casino patron and to provide a corresponding amount of monetary credits to a mobile gaming device 256 for wagering purposes (e.g., via a wireless link such as a near-field communications link). According to some implementations, a digital wallet app running on one of the mobile gaming devices 256 (e.g., on a patron's cell phone) may be configured for wireless communication with gaming devices 104, smart tables 300, or such (e.g., to provide digital wallet-based, cashless "cash-out" and/or "cash-in" transactions at location). In some such examples, when a casino patron 262 is ready to cash out, the casino patron 262 may select a cash out option provided by a mobile gaming device 256, which may include a real button or a virtual button (e.g., a button provided via a graphical user interface) in some instances. In some such examples, the mobile gaming device 256 may send a "cash out" signal to a kiosk 260 via a wireless link in response to receiving a "cash out" indication from a casino patron. The kiosk 260 may provide monetary credits to the patron 262 corresponding to the "cash out" signal, which may be in the form of cash, a credit ticket, a credit transmitted to a financial account corresponding to the casino patron, etc.

In some implementations, the kiosk 260 may be configured to authorize and/or initiate a download of digital wallet software to a patron's mobile device. In some examples, a server of the digital wallet management server 290 may be configured for storing and updating digital wallet software, and for downloading digital wallet software to a patron's mobile device.

In some embodiments, the digital wallet management server 290 may be configured for communication with one or more devices that are configured to implement a player loyalty program, such as the player tracking system server 110. In some embodiments, a member of a casino player loyalty program may input at least some of the member's casino player loyalty program information during the process of creating a digital wallet account. According to some such implementations, the kiosk 260 may be configured as an interface for creating digital wallet accounts. In some examples, during a process of creating a digital wallet account a person may provide casino player loyalty program information to the kiosk 260 by inserting or swiping a player loyalty program card. Alternatively, or additionally, the kiosk 260 may be configured to accept manually-input information that may include, but may not be limited to, casino player loyalty program information.

In some examples, at least some of the mobile gaming devices 256 may be configured for implementing digital wallet transactions with a gaming device 104 or a smart table 300 via Bluetooth or NFC. According to some implementations, the gaming device 104 or smart table 300 may be configured to provide a Bluetooth low-energy (LE) beacon for establishing wireless communication with at least some of the mobile gaming devices 256. In some implementations, the mobile gaming device 256 may implement digital wallet transactions (such as cash in or cash out transactions) with the gaming device 104 or smart table 300 directly, via NFC or Bluetooth. In other implementations, the gaming device 104 or smart table 300 may be able to transmit communications to a mobile gaming device via NFC or the Bluetooth (LE) beacon, but the mobile gaming device may be required to provide input to the gaming device 104 or smart table 300 indirectly (e.g., via one or more devices of a player loyalty system or of a digital wallet management system).

Some embodiments provide alternative methods of establishing a "cardless" connection between a mobile gaming device and an EGM or a smart table. In some such implementations, a player tracking interface of the gaming device 104 or smart table 300 may be configured to establish a wireless connection and a cardless player tracking session with a mobile gaming device. For example, the gaming device 104 may be configured to establish a wireless connection and a cardless player tracking session with a mobile gaming device via the player tracking interface 232 that is described above with reference to FIG. 2A. A smart table 300 may be configured to establish a wireless connection and a cardless player tracking session with a mobile gaming device via an interface system of the table management device 320 that is described below with reference to FIG. 3. In other words, the table management device 320 may be configured to provide a player tracking interface.

In some examples, a player tracking interface of the gaming device 104 or smart table 300 may be configured for wireless communication with a mobile gaming device (e.g., via Bluetooth or NFC). In some such examples, the player tracking interface may include a user interface (e.g., a GUI or a physical button) with which a player can interact in order to obtain a passcode from the player tracking interface. The passcode may, for example, be an RNG code. The passcode may be provided to the player via a display of the player tracking interface. The player may be required to input the code (e.g., via the mobile gaming device) in order to pair the mobile gaming device with the player tracking interface and enable digital wallet transactions with the EGM or the smart table. According to some such implementations, a "cardless" player loyalty session may also be established when the mobile gaming device is paired with the player tracking interface.

Accordingly, in some embodiments, the digital wallet management server 290 may be configured to implement aspects of a casino player loyalty program related to digital wallets and to allow for cardless connection to gaming devices 104, smart tables 300, or kiosks 260. For example, the digital wallet management server 290 may be configured for establishing a rules engine for digital wallets, implementing the rules engine for digital wallets, etc. The rules engine may be configured, at least in part, according to criteria relating to a casino player loyalty program.

Figure 3:
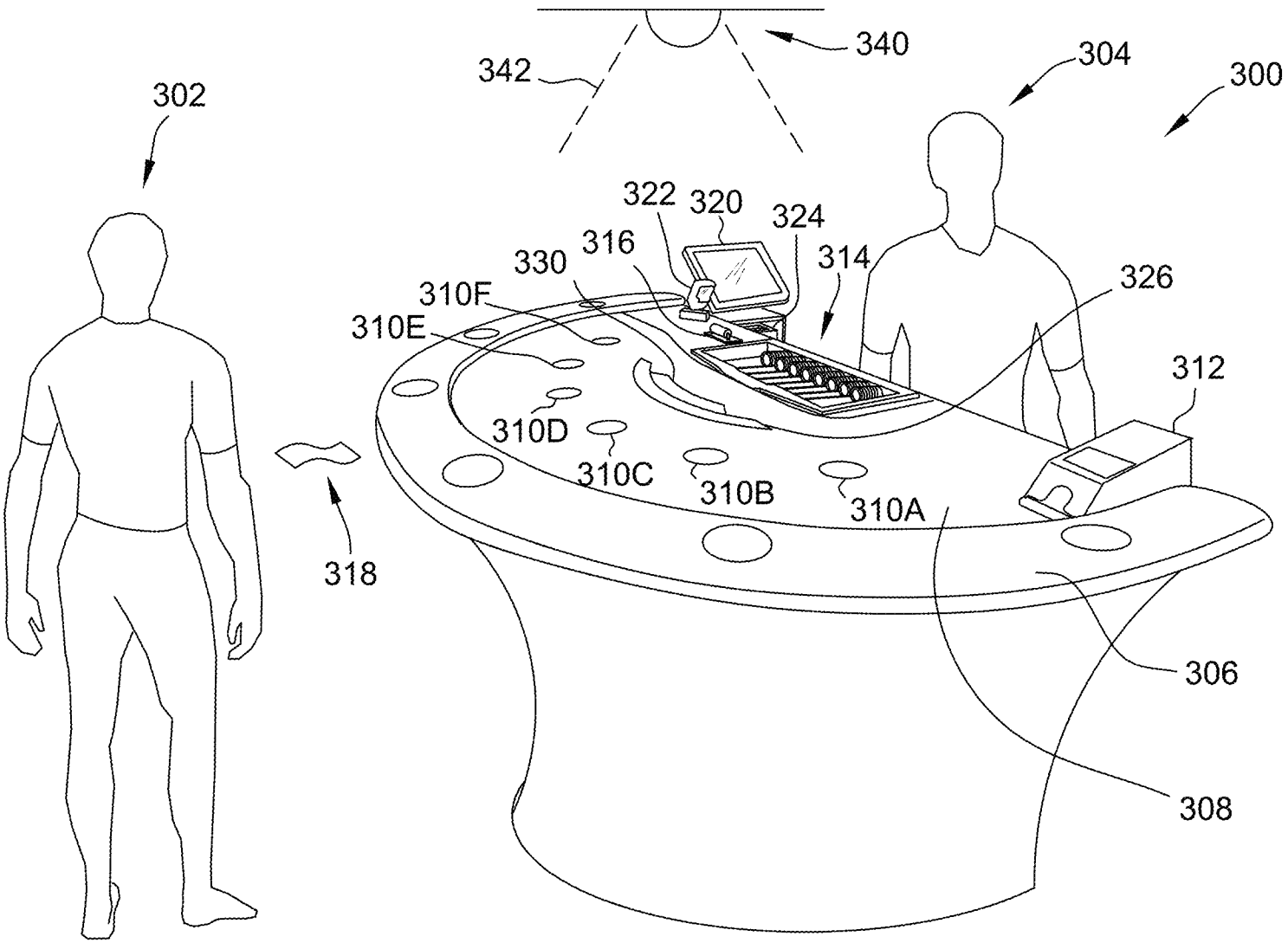
FIG. 3 is a diagram of an example smart table used for table gaming in a casino environment.

FIG. 3 is a diagram of an example smart table 300 used for table gaming in a casino environment. In the example embodiment, a table management system (e.g., including table management system server 106) integrates with the smart table 300 to allow for tracking of rated game sessions for players 302 and to provide various rewards based on game play. The smart table 300, in the example embodiment, includes several player positions, generally represented here by wagering areas 310A-310F (collectively, "wagering areas 310) (e.g., one wagering area 310 per primary player). In this example table game, players 302 typically stand or sit near their wagering area 310 and place wagers (e.g., chips) within the wagering area 310 during the course of play. Wagering areas 310 are typically visually marked on a table surface (or just "surface") 308 of the table 300, such as by circles as shown here. In some embodiments, additional side bet wagering areas (not shown, but similar to wagering areas 310) may be provided on the table 300 for "side bets," allowing the smart table 300 to determine when the player 302 has made a side bet of a particular type (e.g., based on location of RFID chips). The smart table 300 also includes a card shoe 312 from which a dealer 304 dispenses cards during the course of play. In addition, the dealer 304 collects and dispenses chips from a chip inventory maintained in a chip tray 314. The smart table 300 also includes a drop box 316 into which the dealer may deposit cash, tickets, or other items. Further, in some table games, the table surface 308 may include an insurance bar 326 or other such visually-demarcated areas used for the particular table game. Other common table surface areas and hardware may be present but are not illustrated here for purposes of clarity (e.g., automatic card shuffling device, card return tray, additional wagering areas, and so forth).

In the example embodiment, the smart table 300 also includes electronic components of or otherwise used by the table management system. A table management device 320 includes a display and a user interface (both not separately depicted in FIG. 3) through which the dealer 304 or casino management (e.g., pitboss) may interface with the table ticketing system or other systems such as the casino management system or the player tracking system. The table management device 320 is communicatively attached to a ticket reader (or "ticket scanner") device 322 that may be used to scan the tickets 318 presented by players 302 (e.g., during a ticket-in event). A ticket printing device (or just "printer") 324 is attached to the table management device 320, and may be used to generate new tickets 318 (e.g., during a "ticket-out" or chip redemption event, or as a partial reimbursement from a ticket-in event). The table management device 320, in some embodiments, is configured to communicate with the table management system operated by the casino to manage aspects of table games.

In some embodiments, the smart table 300 is configured with one or more chip sensors that may be used in conjunction with the table ticketing system or other systems described herein. In this example, the smart table 300 is configured with one or more radio-frequency identification ("RFID") readers (also referred to herein as "RFID sensors," not separately shown) embedded within (e.g., just underneath the surface 308 of) the table 300. Further, the chips are each embedded with RFID tags (e.g., passive tags) that may be sensed and read by the readers. The particular placement and configuration of each of the RFID readers establishes or otherwise creates RFID areas (or "sensing areas") on the table surface 308 within which chips may be placed and read (e.g., counted for total value) for that particular RFID area. The various RFID sensors provided by the smart table 300 may be configured such as to establish non-overlapping RFID areas. When a particular RFID area does not overlap with any other RFID areas, the chip detection by that associated RFID sensor is isolated from other sensors such that those chips may be considered to be solely within a significant region of the table 300.

In the example embodiment, one RFID area provided by the smart table 300 is a dealer scratchpad 330. In FIG. 3, the dealer scratchpad 330 is visually identified by markings on the table (e.g., an enclosed region identifying where the dealer 304 may put chips when using the dealer scratchpad 330). This visual region also approximately defines the configuration of an underlying RFID reader (not separately depicted) under the table surface 308 300, as well as an associated RFID area within which chips may be detected and associated with that area. During operation, the dealer scratchpad 330 may be used to determine a value of chips being dispensed to the player 302 during a ticket-in (e.g., to verify against a value of the ticket 318), to determine a value of chips being collected from the player 302 during a ticket-out event (e.g., to establish a value for a ticket to be printed), or during chip exchanges between the dealer 304 and the player 302 for cash.

In some embodiments, another RFID reader may be provided that defines an RFID area for the chip tray 314. Such an RFID area allows aspects of chip tracking to and from the chip tray 314. In some embodiments, various player-oriented RFID readers may be provided within the table 300 that define RFID areas used individually by each of the players 302. For example, the smart table 300 may include RFID readers that define RFID areas for each of the wagering areas 310. As such, the value of chips placed within the wagering areas 310 for each player may be automatically determined on demand. In some embodiments, additional play areas (not shown) associated with the play of the table game may be similarly defined by associated RFID readers. Further, in some embodiments, the smart table 300 may include RFID readers that define RFID areas for each player 302's chip inventory (not shown) (e.g., the chips of the player 302 on the table 300 but not currently being used by the player 302). For example, player inventory areas may be defined on the table 300 and approximately adjacent to an interior edge of an arm rest rail 306, where players 302 conventionally maintain their own chip inventories.

In the example embodiment, the smart table 300 is monitored by a security camera (or just "camera") 340 (e.g., a digital video camera). The camera 340 has a field of view 342 of the table surface 308, and transmits video, still images, or other digital image information to a casino surveillance system (not separately shown). The camera 340 may be used to generally monitor aspects of play at the table 300, and may additionally integrate with the table ticketing system to capture digital image information during the various table ticketing events described herein. The camera 340 may sometimes be referred to as the "eye in the sky."

In some embodiments, the smart table 300 and table management system may include a beacon within or otherwise near the table 300 that enables the table management system to use near-field communications (NFC) to detect the presence and position of personal devices of the players at the table 300. In some embodiments, the smart table 300 may include a plug-in or surface charger for each player position, allowing the players to charge their personal devices, and may also provide another mechanism to detect the presence of particular players at particular player positions, or for other communications between the players' personal devices and the table management system.

In some embodiments, the table management system, or the table 300 itself, may include one or more digital camera devices (not shown) that are positioned such as to capture front views of the seated or standing players at or near the table 300. Such digital video may be used for facial recognition applications by the table management system. For example, the table management system may perform facial recognition on people sitting at the various player positions provided by the table, allowing the table management system to automatically detect which known players are sitting at each player position. In some embodiments, facial recognition may be used to verify the identity of the active players at the table 300 or secondary players standing near the table 300 for purposes of authenticating identity of a player as they log into the table management system. In some embodiments, each player position may also include a position label (e.g., a QR code or other machine readable image) displayed at each position and which may be read by the digital camera device(s) and used to uniquely identify a particular table 300 or a particular position 402 at a particular table 300. As such, position occupation at the table 300 may be determined, and in some embodiments, particular player identities may be automatically determined and assigned to the position. In some embodiments, if the player 302 is recognized as an excluded player, the table management system may reject ticket transactions or rated game play. In some embodiments, if the player 302 is recognized as non-compliant in parental support (e.g., in a national "deadbeat dads" database), game play data or ticket transaction data may be reported.

In other embodiments, the smart table 300 may be configured to support other table games such as Roulette, poker, Baccarat, craps, or such real-money wagering games as are commonly played at casinos. In other words, smart table 300 may be a Roulette table, a poker table, a craps table, or such, each of which may include their own particular configurations (not separately shown) which may include alternate configuration of wagering areas 310 and dealer scratchpad 330 that enable the functionality described herein. In a Roulette example, a Roulette table may include chip sensors underneath each of the wagering areas on a conventional Roulette table (e.g., coloured number squares, columns, 0, 00, dozen spaces, odd/even spaces, red/black spaces, split, street, corner, and so forth). Two or more chip sensors may be used in conjunction to determine, for example, split bets (e.g., where a single bet straddles two adjacent wagering areas). The Roulette table may also include a dealer scratchpad 330 and chip tray 314 which the dealer 304 may use in similar fashion (e.g., for chip management, security, chip counting, ticketing, and such other uses as described herein). In a poker example, a poker table may include individual wagering areas for each position at the table (e.g., from which individual player bets may be automatically determined), as well as a central "pot" area (e.g., for determining the current size of the pot). The poker table may also include a display device (not separately shown) that is visible to the dealer 304 and players 302 and that automatically determines and displays such quantities during a hand. In a craps example, a craps table may include chip sensors underneath each of the wagering areas of a conventional craps table (e.g., place bets, don't pass bar, pass line, field, come, and so forth).

In some embodiments, where the number of game rounds is not automatically tracked by the smart table 300, various types of table games may be supported using an estimated rate of game rounds played (e.g., hands per hour, betting rounds per hour, or the like, as entered by the dealer 304) in conjunction with player betting information to determine wager amounts of the players 302. The player betting information may be automatically detected (e.g., using any of the various RFID sensors and methods described herein) or, in some embodiments, an estimate may be used for each player (e.g., average wager per hand, average wager per dice roll, average wager per spin, or the like, as entered by the dealer 304).

Figure 4:
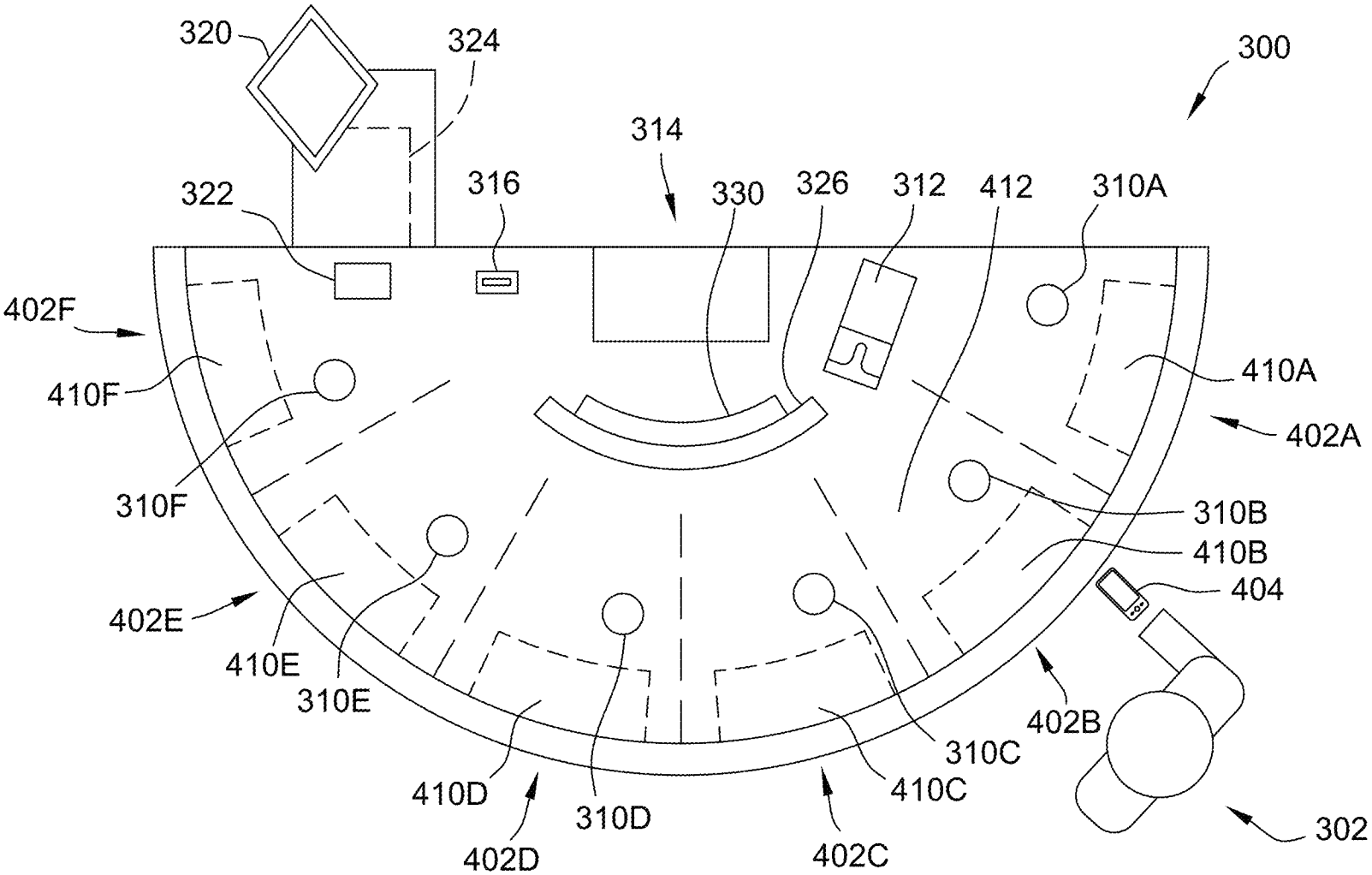
FIG. 4 is an overhead view of the smart table and table management device that are configured to allow the player to use a digital wallet from their mobile computing device to perform buy-in and cash-out actions during a table gaming session.

FIG. 4 is an overhead view of the smart table 300 and table management device 320 that are configured to facilitate player positioning and allow the player 302 to use a digital wallet from their mobile computing device 404 (e.g., mobile gaming device 256) to perform buy-in and cash-out actions during a table gaming session. In some embodiments, the player positioning methods described below may be used in conjunction with the methods described above with respect to FIG. 3. In the example embodiment, FIG. 4 illustrates various play areas or player positions 402A-402F (collectively, "play areas" or "player positions 402") for a table game (e.g., blackjack). The smart table 300 includes various components as shown in FIG. 3, not all of which may be illustrated for purposes of clarity. The diagram shown in FIG. 4 includes several long broken lines that approximately separate the exterior, player-adjacent portion of the table into six player positions 402. It should be understood that more or less player positions 402 may be provided, and that these broken lines may or may not appear as markings on the table, but are used here to illustrate the play area used by an individual player 302 to play the table game (e.g., when sitting or standing near that play area 402).

In some embodiments, one function of the smart table 300 and associated devices is to establish a virtual representation of the table 300 (e.g., in computer memory, database, or such) that identifies which players 302 occupy which particular positions 402 at that table 300. As such, the table management device 320 or the table management system server 106 may create and manage data structures (not shown) for each table 300 (e.g., for some or all smart tables in a particular property, or across multiple properties). These data structures are sometimes referred to herein as a table management database. The table management database may include, for example, table-level information for each smart table 300 (e.g., unique table identifier, table type, number of positions, position identifiers for each position, active dealer, current chip counts), position-level information for each position 402 at a table 300 (e.g., current occupancy status, player identification for that position), or transaction for players (e.g., when player funds table play through use of a voucher, if player has taken a change voucher and redeemed or funded other gaming types, if player has redeemed table chips for a voucher and either redeemed at a redemption source or used for other game play). Such information may also be displayed to the dealer 304 via the UI provided by the table management device 320 as described herein. It should be understood that "table 300" and "positions 402" may be used to refer either to the real-world tables or real-world positions at those tables, to the virtual tables or virtual positions at those tables (e.g., within the table management database), or both, depending on context.

In some embodiments, the table management device 320 allows manual positioning of the player 302 at a particular player position 402. Manual positioning updates the data structure, establishing the presence of the player 302 at their particular position 402 within the table management database. Manual positioning may be initiated by the dealer 304 ("manual dealer-initiated player positioning") or by the player 302 ("manual player-initiated player positioning"), as described below.

In some embodiments, the table management device 320 allows dealer-initiated player positioning. For example, the dealer 304 may use the table management device 320 to associate a selected position at the table 300 with the particular player 302 by scanning or swiping a loyalty card of the player 302 when the player first begins their gaming session at the table 300 to enter the player 302 into rated session play. In some embodiments, the player 302 may perform cardless connect with the table 300 via their mobile device 404, or perform a digital card scan that displays within the player app, to identify the player 302 to the table 300. Once the player 302 has been identified within the table management device 320, the dealer 304 may assign that player 302 to a particular logical position corresponding to their physical position 402 at the table 300. For example, the dealer 304 may select, on a virtual table map (not separately shown) displayed to the dealer 304 on the UI of the table management device 320, the particular position 402 (e.g., position 402B, as shown in FIG. 4) at the table 300 that the particular player 302 actually occupies. As such, the player 302 is virtually assigned to their real-world position.

In another example, the table management device 320 allows player-initiated player positioning. For example, the player 302 may use their personal device 404 to select the table 300 from a map of the casino and the particular position 402 (e.g. position 402B) from a map of that table 300. The property owner, table manufacturer, or other parties may provide a downloadable app ("the app", not shown, e.g., installed on their personal device 404) through which the player 302 can interact with the table management system server 106 or casino management system server 114 to facilitate aspects of the functionality described herein (e.g., player positioning, digital wallet use, turnover tracking, rewards receipt and tracking, and so forth). In some embodiments, the app may provide a map of the casino property and allow the player to select their table and position from the map. In some embodiments, the app may allow the player to scan a position label (e.g., a QR code or other machine readable image) displayed on or near the table that can be used to uniquely identify a particular table 300 or a particular position 402 at a particular table 300. In some embodiments, the player app may determine which table 300 the player 302 is nearest and may allow the player 302 to select a position 402 at which they are seated.

In some embodiments, the dealer may first perform dealer-initiated player positioning and, once entered, the table management device 320 may prompt the player 302 to confirm the dealer-selected positioning (e.g., via the player app on their personal device 404).

In some embodiments, the table management device 320 automatically detects which player position 402 the player 302 occupies at the table 300. The player 302, in this example, is a loyalty member with the casino operator, having a registered player profile with the casino (e.g., a loyalty card, a unique identifier, player information, and so forth, stored within the player tracking system). Further, the player 302 has their mobile computing device (or "EUD" or "personal device") 404 (e.g., their smartphone) on their person during the game play session, and the player 302 has a player application ("player app") installed on their personal device 404. Such verification then associates the particular player 302 to the player position 402 (e.g., position 402B) for a game play session (e.g., via virtual presence as recorded and maintained in a computer memory, such as a table management database).

In some embodiments, the table management device 320 utilizes global positioning system (GPS) functionality to automatically perform position determination for the player 302. More specifically, the table management device 320 may use GPS position information to determine where the player 302 is within the casino and, more particularly, where the player 302 is relative to the smart table 300. For example, the table management device 320 may utilize pre-configured geofencing relative to the smart table 300 to determine whether the player 302 is near the table 300 and optionally which position 402 of the table ("candidate player position 412") the player may be occupying relative to the table 300. For example, each player position 402 may be fenced to include a portion of the table 300 (e.g., where the player 302 may set their mobile device 404) and a seating area adjacent to that position 402 (e.g., where the player 302 may be holding their mobile device 404 or have their mobile device in their pocket, purse, coat, or such). In some embodiments, once a candidate player position 412 for the player 302 is identified, the table management device 320 may prompt the dealer 304 to verify the presence of the particular player 302 at that candidate position 412 (e.g., by displaying the candidate position 412 along with a profile image of the player 302 to the dealer 304 via the UI of the table management device 320). Such is referred to herein as "dealer-verified automatic positioning." In some embodiments, the table management device 320 may prompt the player 302 to verify occupation of the candidate position 412 (e.g., by displaying the table 300 within the casino layout and the candidate position 412 over an image of the table via the player app). Such is referred to herein as "player-verified automatic positioning." In some embodiments, both the dealer 304 and the player 302 may verify the candidate position 412. Such verification then associates the particular player 302 to the player position 402 for a game play session.

In some embodiments, the table 300 may include one or more wireless beacons (not shown) through which the table management system may use, for example, Bluetooth or other NFC technology to automatically and cardlessly connect with personal devices 404 of players 302, determine identities of players 302 (e.g., loyalty IDs, player tracking IDs, or such), and determine positions 402 of various players and their personal devices. The beacon may be, for example, a Bluetooth radio device and associated controller for managing connectivity with player devices (e.g., personal devices 404).

In some embodiments, the table 300 may include surface technology (e.g., NFC, contactless technology) that allows the player 302 to place their device 404 at or near a particular location on the table surface (not separately shown) to allow the table 300 to wirelessly connect with and identify the device 404 and an identity of the associated player 302, and thus associated that player with a particular player position.

For example, each position 402 at the table 300 may include an NFC target device (not shown) embedded below each player inventory area 410 such that, when the player 302 places their personal device 404 near the NFC target device, an NFC connection is established or affected. In some embodiments, the table 300 may provide a designated area outlined on the surface of the table 300 onto which the player 302 is to place their personal device 404 to establish or affect this NFC connectivity (e.g., a circular section, not shown, at each player position 402), and under which the NFC target device is installed. The NFC device may be tuned to have a range of just a few inches in diameter to, for example, avoid accidentally allowing adjacent players 302 to inadvertently connect at an incorrect position 402. As such, during game play, the player 302 may place their personal device 404 to affect automatic player positioning via NFC. In some embodiments, the table 300 may allow the player to pair with the table 300 using a connection code.

In the example embodiment, each play area or player position 402 includes a wagering area 310 within which the player 302 places wagers. As the dealer 304 deals cards from the shoe 312, the dealer 304 places those cards for each player 302 somewhere within the player position 402, allowing the player 302 to see their cards and distinguish their cards from the cards of the other players 302. Further, the smart table 300 also includes player inventory areas 410A-410F (collectively, "player inventory areas 410"), one for each player position 402.

During game play, players 302 typically maintain their personal inventories of chips near themselves and adjacent to the arm rest rail 306 (e.g., the chips that they have not currently placed as a wager). The smart table 300 includes RFID areas underneath each of the player inventory areas 410 that allow the table management device 320 to determine and evaluate the chip inventory of the player 302 for various purposes described herein. In the example embodiment, the short broken lines bordering the player inventory areas 410 approximately indicate where each player 302 may place their chip inventory such as to be readable by the associated RFID reader. As such, the player inventory areas 410 represent where the smart table 300 can detect out-of-play chips of the player 302. The smart table 300 or the table management device 320 may use the RFID sensors of the player inventory areas 410 to detect, for example, a total value of chips held by the player 302, which particular chips are held by the player 302, and chip movement into and out of the player inventory areas 410. In some embodiments, the player inventory areas 410 may be wider or narrower.

For example, the table management device 320 may analyze a value of chips moved from the player inventory area 410B of the player 302 to the wagering area 310B to determine when a wager has been made. The table management device 320 may analyze a value of chips moved from the wagering area 310B to either the player inventory area 410B (e.g., in the case of a player win) or to the chip tray 314 (e.g., in the case of a player loss). Such chip movement may be used to demarcate a single hand played at the table 300 or by the player 302, to validate a proper award amount during a player win, to determine whether the player 302 won or lost the current hand, to determine a specific amount wagered by the player during the current round of play, to determine a specific amount won or lost by the player during a particular hand, to determine a net amount won or lost by the player 302 during their table gaming session, or to determine when the player 302 is leaving the table 300 (e.g., when their chips disappear from the player inventory area 410B and appear on the dealer scratchpad 330 for a ticket-out action or otherwise do not appear on the wagering area 310B). Such data may be referred to herein as "chip movement data" of the player 302.

In the example embodiment, the player 302 has a digital wallet app (or "digital wallet") installed on or otherwise facilitated by their personal device 404. In some embodiments, the player app may be the digital wallet (e.g., a "casino play wallet (CPW")) and may interact with a third-party digital wallet app to facilitate various embodiments described herein. The digital wallet may contain payment account information for various personal financial accounts (e.g., bank accounts, house accounts) and payment cards (e.g., debit cards, credit cards) of the player 302 from which the player 302 may withdraw or deposit funds, and may also contain loyalty card information for the player 302 (e.g., associated with the player tracking system of the casino). Further, in some embodiments, the player tracking system server 110 or other back-end system operated by the casino operator may maintain a financial account on behalf of the player 302 and may allow the player to deposit funds into or withdraw funds from that personal casino account (e.g., as another source of funds) and may provide rewards to the player 302 via their digital wallet.

During table gaming at the smart table 300, in the example embodiment, the table management device 320 facilitates digital wallet-based cashless buy-in, cash-out, and reward tracking, receipt, and redemption actions from or to the digital wallet of the player 302 using their personal device 404. For example, the digital wallet may identify account information for several fund sources, such as personal bank accounts, payment cards, or personal casino accounts of the player 302. During a buy-in transaction, the player 302 may use their personal device 404 to initiate a buy-in with the dealer 304 at the table 300, causing funds from a fund source in the digital wallet to be used (e.g., in lieu of cash or ticket) to acquire chips at the table 300. During a cash-out transaction, the player 302 may use their personal device 404, or the dealer 304 may use the table management device 320, to initiate a cash-out at the table 300, causing funds to be deposited into a target account in exchange for the chips of the player 302. In some embodiments, the casino operator may wish to reward loyalty players with various awards (e.g., free bets, match play, promo bet) based on certain actions or achievements performed or accomplished by the player 302, and may deposit those awards into the digital wallet of the player 302 and alert the player via the player app on their mobile device 404. Some reward achievements may be digital wallet accomplishments, such as a first-time funding of the digital wallet with a threshold amount (e.g., first $100) for game play or performing a digital wallet-based cashless buy-in or cash-out at the smart table 300 or an EGM, or for loyalty accomplishments such as receiving 100 loyalty points during ranked session play.

Figure 5:
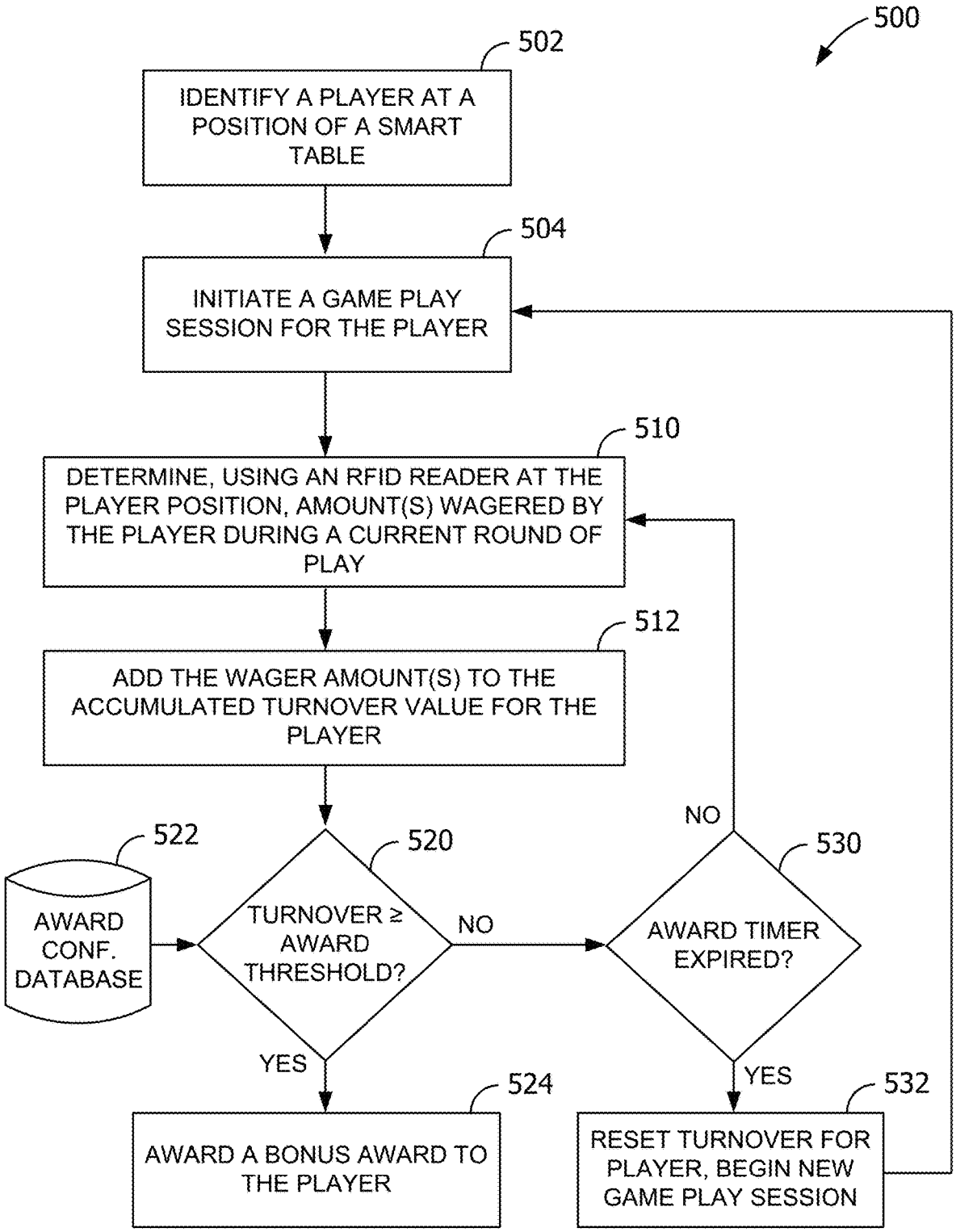
FIG. 5 is a flow chart illustrating an example process for wager and turnover tracking and providing wager and turnover related bonus awards to one or more players of an electronic gaming machine, such as a smart table.

FIG. 5 is a flow chart illustrating an example process 500 for providing a bonus award to a player at smart table 300 during a wagering game, such as, for example, during any of the wagering games described herein and/or during any other suitable wagering game. Further, although not described in additional detail, it will be appreciated that, in at least some embodiments, at least some of the features described below may be provided and/or implemented using a gaming table having a variety of other functionality (e.g., a table excluding NFC devices, and the like). In addition, the various processes and features described below (e.g., for providing bonus awards to players based upon accumulated turnover) may, as described, only be made available to players 302 who have opted into such features. As used herein, players 302 who have opted into wager and turnover tracking may be referred to as "rated" players.

Accordingly, in at least some embodiments, smart table 300 (e.g., a processor associated with smart table 300, such as a processor of table management device 320) and/or a processor of a communicatively coupled backend system, such as table management system server 106, may identify one or more players occupying one or more player positions 402 at smart table 300 (step 502).

As described herein, players 302 may be identified using dealer-initiated player positioning, player-initiated player positioning, or automatic player positioning (e.g., using any of the embodiments described in FIG. 4). For example, in at least some embodiments, an NFC device associated with each player position 402 may detect placement of a personal or mobile computing device 404 proximate the NFC device, where, for instance, NFC devices are embedded or otherwise disposed under table surface 308 in association with each player position 402. In other embodiments, each player position 402 may include a card reader capable of accepting and reading a player card (e.g., a loyalty card), whereby player cards may be inserted by players 302 at each player position 402 to identify players 302 present at smart table 300. Although player identification is described, it will be appreciated that some embodiments may exclude player identification and/or identify players at subsequent steps and/or only under certain conditions (e.g., only when players accumulate turnover sufficient to receive a bonus award). Identifying the position of the player 302 at step 502 may include identifying player identity (e.g., via loyalty card, via mobile computing device 404, or such).

In the example embodiment, upon the player 302 establishing a position at the smart table 300, the smart table 300 (or table management system server 106) begins a rated session ("game play session") for the player 302. In some embodiments, the smart table 300 may access a profile of a known player 302, evaluate whether that player 302 is configured for bonus award play, determine one or more particular potential awards available to the player 302, determine a global or personal timeframe for the rated session or for one or more particular potential awards (e.g., turnover awards), or the like. If the player 302 does not have an active game play session, the table management system may initiate a new game play session, and may perform initial configuration of the game play session (e.g., zeroing out an accumulated turnover value). For example, the smart table 300 (or table management system server 106) may record a start time of the rated session and may track ongoing game play statistics during the rated session (e.g., for evaluation and award determination), or otherwise begin a game play session if the identified player 302 does not already have an active game play session (step 504).

During each round of play, the smart table 300 determines wager amounts applied by the player (step 510). Each wager amount applied by the player is added to an accumulated turnover value associated with that player 302 and their active game play session (step 512). As described more briefly above, and as used herein, the terms "turnover" and "accumulated turnover" refer to a total or aggregate amount wagered by a player during a time period, where the time period may be variously set by, for example, a casino operator. For example, if a time period of two hours is established, a player may accumulate turnover in the aggregate amount wagered by the player during the two-hour period.

In some embodiments, turnover may be accumulated from a variety of wagering devices during a game play session (e.g., one or more table games, one or more EGMs, and the like), depending, for example, upon a player's travel and play habits within a casino during the time period. For example, the player 302 may initially begin a rated session at a smart table 302 (e.g., playing blackjack), kicking off a 2-hour bonus window. The player 302 may generate an initial turnover amount at the smart table 302 before migrating to a gaming device 104. At the gaming device 104, and still within the 2-hour bonus window, the player 302 may generate additional turnover amount that is incremented to the initial turnover amount. The player 302 may subsequently move to another smart table 300 (e.g., roulette) where they generate a further turnover amount until the bonus window expires. If the total accumulated turnover exceeds the bonus threshold, then the bonus is awarded to the player 302. Further, it should be understood that turnover is unaffected by actual return to player (RTP). For example, a player who wagers 1,000 credits during a two-hour time period and who wins 2,000 credits has an accumulated turnover, during the time period, of 1,000 credits, irrespective of the actual RTP. Likewise, a player who wagers 1,000 credits and wins 500 credits during the time period, also has an accumulated turnover of 1,000 credits.

To determine wager amounts of the player 302 at smart table 300, smart table 300 may, in at least some embodiments, track transfer or movement of RFID chips (as described herein) into player wagering areas 310 (e.g., during a tracked round of play). Specifically, as RFID chips are moved by player 302 from the player's inventory area 410 to the payer's wagering area 310, smart table 300 may read a chip value of each chip that the player 302 moves into the wagering area 310, whereby the player's total wager may be determined and stored, such as in a memory device of smart table 300 and or table management server 106. Such determination at step 504 of the wager amount of the player 302 in wagering area 310 is determined for each game round (e.g., determining a wagering amount of the player 302 for each hand of blackjack, for each spin of a roulette wheel, and so forth). In some embodiments, the smart table 300 automatically determines the beginning of a round of play and may determine a current wager amount for addition to the turnover based on an initial wager amount in the wagering area 310 at or after the determined start of the current round, and potentially any additional incremental wagers added to the wagering area 310 during the round of play (e.g., doubling down or splitting in blackjack, each of which adds additional chips beyond the initial wager).

For example, in one embodiment, the smart table 300 may include a smart shoe 312 to determine when the first card of a game round is dealt from the shoe (e.g., the first card draw event of a game round, based on output from a card deal sensor in the shoe 312). The smart shoe 312 is configured with a sensor that allows the smart table 300 to detect when a card is drawn from the shoe 312 (a "card draw" event). Upon detecting the first card draw of the game round, the smart table 300 may automatically change a state of the smart table 300 into a new round and may capture an initial wager amount for the player 302 at this time. While the game round is active, the dealer 304 continues to administer the game round to the players 302. In this blackjack example, an initial deal of two cards is dealt to each primary player 1002 as well as to the hand of the dealer 304. During this time, no chips are typically allowed to be added or removed from the wagering areas 310. Once all initial hands are dealt, the players are provided an opportunity to play each of their hands in order, typically starting from the "A" position and moving clockwise until all players have played. Some players may have achieved a natural blackjack, and thus may be immediately paid during their turn. Payment of the player at this stage may be detected based on chips moving from the chip tray 314 to the wagering area 310 of that player 302. Such chip movement may be automatically detected and determined to be the conclusion of the game round for that player 302. Similarly, if the primary player 1002 "busts" (e.g., draws more than 21 during their turn), the dealer 304 moves the chips of the player 302 from the wagering area 310 to the chip tray 314. Such chip movement may be detected by the smart table and determined to be the conclusion of the current game round for that player 302. Either a blackjack win or player bust by the primary player during their turn effectively ends the game round for the player 302. In some embodiments, the smart table 300 may automatically determine that the game round has ended when the dealer 304 turns over the house hand card based on movement of the cards to a particular area on the table 300 (e.g., using RFID-enabled cards), based on a button press by the dealer 304, or based on the dealing of the next cards after a pre-determined minimum delay between the last card dealt and the next card dealt (e.g., from the smart shoe).

Further, as gameplay progresses, such as over the course of multiple hands of a poker or blackjack game, smart table 300 aggregates the wagers (e.g., based upon chip values) placed by the player 302 over the course of the multiple hands to calculate an aggregate or accumulated turnover by the player 302 during their play session (step 512). In some embodiments, the smart table 300 may store such wager amounts for each player 302 or position 402 and may transmit such game round data to a central server (e.g., the table management system server 106) for tracking, for application to ongoing player accumulated turnover computations, or such.

As described herein, turnover aggregated or accumulated by a player may be calculated for any suitable time period, such as any time period set or established by a casino operator. Accordingly, a variety of time periods may be established by casino operators in conjunction with a variety of promotions, competitions, incentives, and the like. Time periods may, in addition, be established in conjunction with a variety of threshold turnover values. For example, an incentive or promotion comprising a time period of two hours and a threshold turnover value of 10,000 credits may be established by a casino operator and advertised within the casino. In this example, players might attempt to reach an accumulated of turnover in the specified amount (10,000 credits) within the specified time period (two hours). In some embodiments, time periods may have predefined starting and ending times. However, in other embodiments, players 302 may indicate (e.g., via a mobile app installed on their mobile computing device 404) when a time period should begin (e.g., when they wish to begin competing for a threshold turnover).

Turnover goals and time periods may also be established for players 302 based upon player status or player groupings, such as, for example, based upon player tiers in a hierarchical tier structure of a loyalty program. In one example embodiment (as described above), players 302 may not be allowed to participate in wager and turnover tracking unless they are "rated," meaning that they have established a player account and positively opted into wager and turnover tracking.

In at least one example embodiment, a hierarchical tier structure may group players into a variety of color-coded tiers or levels, such as a (first) bronze tier, a (second) silver tier, and a (third) gold tier of a loyalty program. Players in the first tier may participate in a first incentive having a first turnover threshold or turnover goal (e.g., 10,000 credits) a first specified time period (e.g., 4 hours), and a first bonus award (e.g., $1,000 in casino complimentary credit). Likewise, players in the second tier (where the second tier is higher status) may participate in a second incentive having a second turnover threshold or turnover goal (e.g., 15,000 credits) a second specified time period (e.g., 3 hours), and a second bonus award (e.g., $2,500 in casino complimentary credit). Players in the third (highest status tier) may participate in a third incentive having a third turnover threshold or turnover goal (e.g., 20,000 credits) a third specified time period (e.g., 2 hours), and a third bonus award (e.g., $5,000 in casino complimentary credit).

In some embodiments, participation in an incentive may be limited to only at certain smart tables 300 or at certain gaming devices 104. For example, an operator may provide the incentive at higher minimum-wager tables 300 or marquee gaming devices 104, or at particular table games, thereby incentivizing particular types of gaming over others. In some embodiments, participation may be limited to particular minimum bet levels at tables 300 or gaming devices 104 (e.g., available only on max bet at slot machines, video poker, or the like).

As a result, turnover goals (e.g., turnover thresholds and time periods) may be customized to improve player excitement and based upon player spending habits and spending limits. For example, so-called "high rollers" may be grouped into a "gold" tier, which may provide better or higher value bonus awards and which may pose a greater challenge to players desiring increased excitement and payout opportunities. Bonus prizes may also be tailored to players based upon one or more player preferences, which may be determined, in at least some embodiments, from profile data associated with rated players. For example, a player account of a rated play may suggest that the player is interested in fashion products. As a result, the player 302 may be provided a customized turnover incentive that includes a bonus award related to or including a fashion product or service, such as a two-hour complimentary spa visit at a casino. Likewise, a player whose player account indicates that the player 302 is interested in sports, such as car racing or football, may be provided a customized turnover incentive that allows the player 302 to play for a new car or tickets to a professional football game.

In the embodiments described herein, bonus awards are provided to players 302 when they satisfy turnover threshold and time period requirements in association with a particular incentive. In other words, in at least some embodiments, once the player 302 reaches a turnover threshold within a specified time period, the player 302 is guaranteed an associated bonus award. Further, in at least some embodiments, to add an additional layer of customization, the player 302 may be provided a list of turnover incentives, such as via the player's EUD 264. The player 302 may thus review and select one or more turnover incentives that are interesting to the player using their personal computing device 404. Such configuration of potential awards (e.g., settings), associations between particular awards and players 302, may be stored in an award configuration database 522.

In the example embodiment, the table management system checks to see if the player 302 has achieved an award after each game round. If, at test 520, the player 302 has achieved an award (e.g., if the value of their current aggregate turnover meets or exceeds an award threshold for a particular award), then the player 302 is awarded the associated reward (step 524). In some embodiments, the table management system may perform test 520 at the conclusion of a specified time period (e.g., at the conclusion of a particular turnover incentive). Smart table 300 and/or table management system server 106 may compare turnover accumulated by the player 302 at smart table 300 to the threshold turnover associated with that player 302 (e.g., if players are included in different tiers, as described above). The comparison may be used to determine whether the player 302 has satisfied their respective turnover and time period goals. In response to determining that turnover accumulated by the player 302 is greater than or equal to a turnover threshold or turnover goal as well as that the player 302 accumulated the requisite turnover within the assigned time period, one or more bonus awards may be provided to the player 302 when they satisfy their turnover and time period goals. If the accumulated turnover of the player 302 has not reached a specified turnover threshold and time remains in the specified time period (test 530), the running turnover value of the player 302 may continue to aggregate, returning to step 510. Each time the player 302 places a wager (e.g., by moving RFID chips, as described herein), the accumulated turnover of the player 302 may be recalculated and compared to the threshold turnover associated with the player 302. If the award timer has expired, then the table management system may reset the turnover for the player 302 (e.g., without the player 302 having achieved the award) and may reset counters and begin a new game play session (step 532), returning to step 504. In the example embodiment, the disposition of test 530 allows the player to begin the next round of play and to accumulate credit for that next round even if the award timer expires during that round of play. In some embodiments, test 530 may occur after step 512 and before test 520, and thus may only allow the bonus to be awarded if the award timer has not yet expired at the end of the round.

As described herein, in some embodiments, bonus awards may include, but are not limited to, complimentary casino credit, loyalty points, vouchers, and other redeemable awards. In some embodiments, awards of this type may be added to a player account, and an indication of the award may be provided to the player on the mobile computing device 404 of the player and/or on a display device of smart table 300. Bonus awards may also include physical objects, such as vehicles and/or any other object that a player may wish to receive. Awards of this type may be provided to a player by a casino (and/or funded from a casino marketing account), and an indication that the player has been awarded such a bonus award provided, as above, to the mobile computing device 404 of the player 302 (e.g., via player app, SMS text message, email) and/or displayed on display device 320 of smart table 300. In some embodiments, achievement of the bonus awards may cause a reward ticket to be printed at the ticket printer 324, after which the dealer may present the reward ticket to the player 302. In some embodiments, a player account of the player 302 may be credited with the award or with an indication of the award, and the player 302 may view and redeem the award through, for example, a kiosk, at a point of sale (e.g., for merchandise, food, or beverage), or at a casino cage or member service desk. In some embodiments, promotions may be sent to the player 302 via text notification, email, the player app, a mailer to the player, through casino personnel (e.g., via dealer 304 or courtesy service attendant, and e.g., at the table, cage, player desk, point-of-sale outlets), informing the player 302 of the availability of this bonus program, restrictions, rules, limitations, and such.

In some embodiments, a progress meter may be provided to the player 302 to inform the player of their progress, during a specified time period, towards a particular threshold turnover (or turnover goal). For example, in at least some embodiments, one or more progress meters may be provided on a display device (or devices) of smart table 300, whereby players participating in a wagering game played on smart table 300 are able to see running visual indications of their progress or advancement towards respective turnover goals. In some embodiments, progress meters may include progress bars (e.g., "thermometers," where temperature indicates relative completion or progress), pie charts, lighting configurations (e.g., green lights, yellow lights, red lights, etc.), and other types and styles of meters.

In some embodiments, progress towards a particular bonus award may be displayed in association with the bonus award itself (or a representation thereof). For example, as described above, if the player 302 selects a bonus award including football tickets, the player's progress towards the bonus award may be displayed in the form of a football game, where the player's team progresses towards an end zone representing completion of the incentive. Likewise, a player who has selected a vehicle as a desired bonus award may be provided an indication of their progress towards the vehicle in the form of a car race or another vehicle-related presentation.

In related embodiments, each player position 402 may include a lighting element, such as an array of light emitting diodes (LEDs), a video display, and/or any other suitable lighting or display device. During gameplay, players who are opted in and playing towards respective turnover thresholds may be provided individual visual indications of the advancement or progress. For example, in at least one embodiment, a lighting element proximate or associated with a player position 402 may change color, increase in brightness, and/or flash in accordance with a player's progress towards a turnover threshold. For example, a lighting element may increase in brightness to indicate that a player is advancing towards a turnover threshold and/or diminishing time remaining. Likewise, a lighting element may flash more rapidly to indicate increasing progress towards a turnover threshold and/or diminishing time remaining.

Accordingly, in a variety of embodiments, the player 302 may be provided a visual indication of advancement towards a turnover threshold (or turnover goal). In some embodiments, advancement may be indicated via one or more display devices of smart table 300. Likewise, in some embodiments, advancement may be indicated via one or more lighting elements associated with player positions 402. Further, in at least some embodiments, advancement towards a turnover threshold may be indicated to a player via the player's EUD 264. For example, a text message may be provided indicating a percentage complete or a percentage remaining. In another embodiment, a meter or graph (as described herein) may be provided in a mobile app, which may be displayed by the player's EUD 264, and which may indicate progress or advancement in a visual or numerical format.

In addition, and in some embodiments, players may participate in a race towards one or more turnover thresholds. For example, players at the smart table 300 and/or all rated and participating players within a casino or across a set of gaming properties may compete or race towards respective turnover goals. In some embodiments, only players 302 within a same tier (as described herein) may race against one another. During a competition or race, a bonus award may be provided to a player who reaches a respective turnover threshold first in time and/or, in some embodiments, a variety of prizes (e.g., first, second, and third place bonus awards) may be provided to players who reach respective turnover thresholds first, second, and third in time, respectively.

Similarly, and as described more briefly above, in at least some embodiments, players 302 may form teams, each of which may race towards a group or team turnover goal. For example, two or more players 302 may join together as a team (e.g., via an option provided by each of their mobile computing devices 404) to race against two or more other players 302, and the first team reaching a combined turnover goal (e.g., twice the turnover goal of the players forming each team) may be provided a particular bonus award.

In some embodiments, players 302 may, as described above, contribute accumulated turnover to one or more other players 302 to push the one or more other players 302 towards a turnover goal. If the players 302 receiving turnover allocations reach respective turnover thresholds, bonus awards may be split or otherwise evenly allocated (e.g., as a function of percentage turnover allocated towards total threshold required) between all players 302 contributing to the split.

During team (and some individual) play events, players 302 may also reverse-allocate all or a portion of their accumulated turnover to one or more other players 302. Such reverse-allocation may deduct a player-specified amount of accumulated turnover from the accumulated turnover of the player in initiating the reverse allocation. However, the amount deducted (or in some cases a percentage of the amount deducted) from the initiating player's total accumulated turnover may also be deducted from one or more other participating player's accumulated turnovers (e.g., randomly, as specified by the initiating player, and the like). As a result, players 302 may, in at least some embodiments, use all or a portion of their accumulated turnover to set other players 302 back in their own respective advances towards turnover thresholds. Stated another way, various embodiments of the wagering games described herein may be played offensively (e.g., as a team to reach a single turnover threshold) and/or defensively to offset other participating players.

Similarly, in some embodiments, players may allocate all or a portion of an accumulated turnover to a dealer of smart table 300, such as, for example, as a form of "insurance." In such an embodiment, the player allocating turnover to the dealer may be provided a secondary award having a value less than a value of a primary bonus award, but the player may be guaranteed the secondary award, provided, for example, the player allocates a smaller amount of turnover to the dealer (e.g., half the turnover required to reach the turnover threshold associated with the primary award).

Accordingly, a variety of specific improvements to technology (e.g., tables and table games) and technological fields (e.g., table gaming, team and competitive play, wager and turnover tracking) are described. For instance, at least one specific improvement to table games and table gaming consists in the ability of smart table 300 to monitor and track player wagers and associated turnover using RFID devices integrated within smart table 300. Likewise, integration of one or more NFC devices within smart table 300, as described above, also facilitates and enables player identification and wager tracking, particularly, as described, in combination with turnover tracking, which may be used to provide one or more incentives or awards to players based upon their accumulated turnover within a casino, including, but not limited to, at smart table 300.

The various customization features described herein embody another specific improvement to table games, table gaming, wager and turnover tracking, etc. For example, as described, bonus awards may be customized or selected based upon player preferences (e.g., players may select casino credits, physical objects, and the like). In various embodiments, turnover and timing requirements may also be customized based upon player rankings or levels, such as, for example, within a tier structure (e.g., bronze, silver, and gold players may play for different bonus awards under different threshold and timing conditions). Likewise, players may join in teams to reduce turnover demands on individual players as well as reverse-allocate turnover to other players, in some competitive games, in a variety of customization features. Further still, in at least some embodiments, players may be permitted to allocate or hand-in accumulated turnover to a dealer prior to the expiration of a time period for a runner-up or secondary style award.

A computer, controller, or server, such as those described herein, includes at least one processor or processing unit and a system memory. The computer, controller, or server typically has at least some form of computer readable non-transitory media. As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits "configured to" carry out programmable instructions, and these terms are used interchangeably herein. In the embodiments described herein, memory may include, but is not limited to, a computer-readable medium or computer storage media, volatile and nonvolatile media, removable and non-removable media implemented in any method or technology for storage of information such as computer readable instructions, data structures, program modules, or other data. Such memory includes a random access memory (RAM), computer storage media, communication media, and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

As indicated above, the process may be embodied in computer software. The computer software could be supplied in a number of ways, for example on a tangible, non-transitory, computer readable storage medium, such as on any nonvolatile memory device (e.g. an EEPROM). Further, different parts of the computer software can be executed by different devices, such as, for example, in a client-server relationship. Persons skilled in the art will appreciate that computer software provides a series of instructions executable by the processor.

While the invention has been described with respect to the figures, it will be appreciated that many modifications and changes may be made by those skilled in the art without departing from the spirit of the invention. Any variation and derivation from the above description and figures are included in the scope of the present invention as defined by the claims.

What is claimed is:

1. A table management system comprising:

a smart table configured to provide a wagering game, the smart table including a plurality of player positions, each player position associated with at least one radio-frequency identification (RFID) reader of a plurality of RFID readers, and each RFID reader configured to read data from one or more RFID chips on the smart table;

a memory device storing a plurality of player tiers including a first player tier and a second player tier, the first player tier being associated with a first turnover threshold and the second player tier being associated with a second turnover threshold that is less than the first turnover threshold; and a processor configured to execute instructions stored on the memory device, which when executed, cause the processor to at least:

identify a player at a player position of the plurality of player positions;

assign the player to the first player tier based, at least in part, on prior wagering activity of the player;

determine, using the at least one RFID reader associated with the player position, a turnover accumulated by the player during a specified period, the turnover being an aggregate amount wagered during the specified period;

display on a display device, a progress meter displaying a visual indication of progress of the turnover compared to the first threshold turnover and display progresses of other players in the first tier toward the first threshold turnover for comparison of the different players' progress;

compare the turnover accumulated by the player to the first threshold turnover; and in response to the turnover equaling or exceeding the first threshold turnover, grant a bonus to the player.

2. The system of claim 1, the processor further configured to:

determine a first player in the first tier to reach the first turnover threshold of the plurality of different players;

grant the bonus to the first player;

determine a second player in the first tier to reach the respective turnover threshold of the plurality of different players; and grant an additional bonus to the second player, wherein the additional bonus granted to the second player has a value that is less than the bonus granted to the first player.

3. The system of claim 1, the processor further configured to at least:

add an aggregate amount wagered using a different wagering device to the turnover accumulated by the player at the smart table to maintain a running turnover accumulated by the player during the specified period, the running turnover accumulating within a casino as the player moves between at least two different wagering devices, including the smart table and the different wagering device, during the specified period.

4. The system of claim 1, the processor further configured to allow the player to provide at least a portion of the turnover accumulated by the player to one or more of the different players.

5. The system of claim 1, the processor further configured to present the player a plurality of bonus options, receive an input from the player indicating a selected one of the bonus options and, upon the player reaching the threshold turnover of the selected bonus option grant the selected bonus option to the player.

6. The system of claim 1, the processor further configured to control a camera to biometrically identify the player.

7. The system of claim 1, wherein players having a first wagering activity are assigned to the first player tier and players having a second wagering activity are assigned to the second player tier.

8. The system of claim 1, the processor further configured to at least display the progress meter in the form of a progress bar, pie chart, or lighting configuration, wherein the processor is further configured to: in response to at least one wager by the player, control the display device to update the progress meter of the turnover accumulated by the player to the threshold turnover needed to receive the bonus, whereby the player is provided a running indication of advancement by the player towards receiving the bonus.

9. The system of claim 1, wherein each player position includes a respective display device in a surface of the smart table, the processor further configured to:

control the respective display device associated with the player position of the player to display a changing lighting sequence as the player accumulates turnover and advances towards receiving the bonus.

10. The system of claim 1, wherein each player position includes a near field communication (NFC) device configured to detect the presence of an end user device (EUD) of a player when the EUD is placed in proximity to the NFC device, the processor further configured to:

detect an EUD of the player in response to the EUD of the player being placed on a surface of the smart table in proximity to the NFC device; and in response to detecting the EUD, identify a player account of the player at the player position.

11. The system of claim 10, the processor further configured to at least:

track, using a first RFID reader disposed proximate a player inventory area and a second RFID reader disposed proximate a player wagering area, one or more RFID chips being moved from the player inventory area to the player wagering area;

determine, based upon the tracking, a value associated with each RFID chip moved from the player inventory area to the player wagering area; and aggregate the value associated with each RFID chip moved from the player wagering area to the player wagering area to calculate the turnover accumulated by the player.

12. The system of claim 11, the processor configured to at least:

store, in the memory device, the turnover accumulated by the player in association with the player account of the player at the player position; and at least one of periodically or in real-time, provide the turnover accumulated by the player to the EUD of the player, whereby the EUD of the player is configured to at least one of periodically or in real-time display an indication of the turnover accumulated by the player.

13. The system of claim 1, the processor further configured to at least:

identify a plurality of players, each player at a respective player position of the plurality of player positions;

determine, using at least one RFID reader associated with each respective player position, a turnover accumulated by each player of the plurality of players;

determine a threshold turnover for each player of the plurality of players;

compare the turnover accumulated by each player to the threshold turnover for each player; and in response to the turnover accumulated by one or more players being one of greater than or equal to the threshold turnover for each of the one or more players, grant at least one bonus to the one or more players.

14. The system of claim 13, the processor further configured to at least:

control the display device to display a comparison of the turnover accumulated by each player to the threshold turnover for each player; and grant the at least one bonus to the player whose accumulated turnover reaches an associated threshold turnover, whereby the plurality of players are encouraged to compete to reach their respective threshold turnovers.

15. The system of claim 13, the processor further configured to at least:

receive an allocation, by at least one player of the plurality of players, of the turnover accumulated by the at least one player;

transfer the allocation of the turnover accumulated by the at least one player to at least one other player of the plurality of players, whereby the turnover accumulated by the at least one other player is increased by an amount equal to the allocation; and in response to granting the at least one bonus to the at least one other player, split the bonus between the at least one player and the at least one other player.

16. The system of claim 1, the processor further configured to at least:

receive an allocation, from the player to a dealer of the smart table, of the turnover accumulated by the player during the specified period, the allocation received prior to an expiration of the specified period; and in response to receiving the allocation, grant a secondary bonus to the player, the secondary bonus associated with a value less than a value of the bonus provided in response to the accumulated turnover of the player being equal to or greater than the threshold turnover during the specified period.

17. A smart table for supporting play of a wagering game comprising:

a table surface defining a plurality of player positions;

a plurality of RFID readers each associated with at least one player position of the plurality of player positions, each RFID reader configured to read data from one or more RFID chips on the smart table;

a memory device storing a plurality of player tiers including a first player tier and a second player tier, the first player tier being associated with a first turnover threshold and the second player tier being associated with a second turnover threshold that is less than the first turnover threshold; and a processor configured to execute instructions stored on the memory device, which when executed, cause the processor to at least:

identify a player at a player position of the plurality of player positions;

assign the player to the first player tier based, at least in part, on prior wagering activity of the player;

determine, using the at least one RFID reader associated with the player position, a turnover accumulated by the player during a specified period, the turnover being an aggregate amount wagered during the specified period;

cause a progress meter to be displayed on a display device, the progress meter displaying a visual indication of progress of the turnover compared to the first threshold turnover; and cause progresses of a plurality of different players in the first tier toward the first threshold turnover to be displayed on the display device for comparison of the different players' progress.

18. The smart table of claim 17, the processor further configured to allow the player to provide at least a portion of the turnover accumulated by the player to one or more of the different players.

19. A non-transitory computer-readable medium containing instructions embodied thereon which, when executed by at least one processor, causes the at least one processor to:

store a plurality of player tiers including a first player tier and a second player tier, the first player tier being associated with a first turnover threshold and the second player tier being associated with a second turnover threshold that is less than the first turnover threshold;

identify a player at a player position of a gaming table, the gaming table including a plurality of player positions, each player position associated with at least one radio-frequency identification (RFID) reader of a plurality of RFID readers, and each RFID reader configured to read data from one or more RFID chips of the gaming table;

assign the player to the first player tier based, at least in part, on prior wagering activity of the player;

determine, based on readings from the at least one RFID reader associated with the player position, a turnover accumulated by the player during a specified period, the turnover being an aggregate amount wagered during the specified period;

cause a progress meter to be displayed on a display device, the progress meter showing a visual indication of progress of the turnover compared to the first threshold turnover and cause progresses of other players in the first tier toward the first threshold turnover to be displayed on the display device for comparison of the different players' progress;

compare the turnover accumulated by the player to the first threshold turnover; and in response to the turnover equaling or exceeding the first threshold turnover, grant a bonus to the player.

20. The non-transitory computer-readable medium of claim 19, wherein the instructions, when executed by the at least one processor, further cause the at least one processor to:

determine a first player in the first tier to reach the first turnover threshold of the plurality of different players;

grant the bonus to the first player;

determine a second player in the first tier to reach the respective turnover threshold of the plurality of different players; and grant an additional bonus to the second player, wherein the additional bonus granted to the second player has a value that is less than the bonus granted to the first player.

* * * * *